US010781037B2

(12) United States Patent
Fenneman et al.

(10) Patent No.: US 10,781,037 B2
(45) Date of Patent: Sep. 22, 2020

(54) ROOF FOR A MODULAR SHIPPING CONTAINER

(71) Applicant: WABASH NATIONAL, L.P., Lafayette, IN (US)

(72) Inventors: Mitch Fenneman, Lafayette, IN (US); Nicholas Hatcher, Lafayette, IN (US)

(73) Assignee: Wabash National, L.P., Lafayette, IN (US)

( * ) Notice: Subject to any disclaimer, the term of this patent is extended or adjusted under 35 U.S.C. 154(b) by 208 days.

(21) Appl. No.: 15/280,583

(22) Filed: Sep. 29, 2016

(65) Prior Publication Data

US 2018/0086551 A1 Mar. 29, 2018

(51) Int. Cl.

| | |
|---|---|
| ***B65D 88/52*** | (2006.01) |
| ***B65D 88/02*** | (2006.01) |
| ***B65D 88/12*** | (2006.01) |
| ***B65D 90/00*** | (2006.01) |
| ***B65D 6/26*** | (2006.01) |

(52) U.S. Cl.
CPC ..... *B65D 88/522* (2013.01); *B65D 7/30* (2013.01); *B65D 88/121* (2013.01); *B65D 88/129* (2013.01)

(58) Field of Classification Search
CPC ..... B65D 88/522; B65D 88/022; B65D 7/30; B65D 90/008; B65D 88/121; B65D 88/129
USPC ..... 220/4.33, 1.5
See application file for complete search history.

(56) References Cited

U.S. PATENT DOCUMENTS

| | | | | |
|---|---|---|---|---|
| 3,684,122 A * | 8/1972 | Bonomi | B65D 88/522 220/1.5 |
| 4,836,395 A * | 6/1989 | Goutille | B65D 88/121 220/1.5 |
| 5,265,748 A * | 11/1993 | Furukawa | B65D 88/121 220/1.5 |
| 2014/0069912 A1* | 3/2014 | Fenton | B65D 88/121 220/1.5 |

* cited by examiner

*Primary Examiner* — Andrew D Perreault
(74) *Attorney, Agent, or Firm* — Quarles & Brady LLP

(57) ABSTRACT

A roof for a modular shipping container is provided. The modular shipping container includes a first end wall, a second end wall, a first side wall, and a second side wall. The roof includes a roof sheet having a top surface and defining a first end, a second end, a first side, and a second side. The roof further includes a pair of skid plate assembles. One of the pair of skid plate assembles is arranged along the first side of the roof sheet, and the other of the pair of skid plate assemblies is arranged along the second side of the roof sheet. The pair of skid plate assemblies partially extend over the top surface of the roof sheet. The roof sheet is formed of a unitary piece of material.

18 Claims, 32 Drawing Sheets

ROOF FOR A MODULAR SHIPPING CONTAINER

RELATED APPLICATIONS

Not Applicable.

BACKGROUND

Shipping containers used to move cargo are generally large box-like structures. Providing these shipping containers to users in the field is difficult due to their weight and size. As such, a limited number of containers can be moved at one time in a fully assembled form. To overcome this logistical hurdle, some shipping containers are designed to be modular. That is, modular shipping containers are designed to be shipped in a disassembled state and then reassembled on-site.

An inherent property of modular shipping containers is that they include various disconnected parts, which must be assembled by an end user to ensure the parts are properly connected and aligned to form the container. An end user of modular shipping containers may experience significant costs associated with the time required to assemble a container, and the shipping space occupied by the container in a disassembled state (i.e., a shipping space may define how many containers are shipped to an end user). Additionally, improper assembly may lead to potential leak paths forming within the container.

SUMMARY

The present invention provides systems and method for a modular shipping container. In one aspect, the present invention provides a base for a modular shipping container. The base includes a base frame having a first end rail, a second end rail, a first side rail, and a second side rail. The first end rail is attached to first ends of the first side rail and the second side rail, and the second end rail is attached to second ends of the first side rail and the second side rail to form a periphery of the base. The base further includes a pair of fork tunnel assemblies removably coupled to the first side rail and the second side rail and extending therebetween. The pair of fork tunnel assemblies are spaced along the base frame to define a fork pocket distance therebetween. The fork pocket distance defined between the pair of fork tunnel assemblies is configurable between a first fork pocket distance and a second fork pocket distance.

In another aspect, the present invention provides a modular shipping container including a base. The base includes a base frame having a first end rail, a second end rail, a first side rail, and a second side rail. The first end rail is attached to first ends of the first side rail and the second side rail, and the second end rail is attached to second ends of the first side rail and the second side rail to form a periphery of the base. The modular shipping container further includes a pair of fork tunnel assemblies removably coupled to the first side rail and the second side rail and extending therebetween. The pair of fork tunnel assemblies are spaced along the base frame to define a fork pocket distance therebetween. The modular shipping container further includes a first end wall, a second end wall, a first side wall, a second side wall, and a roof configured to be coupled to the first end wall, the second end wall, the first side wall, and the second end wall opposite the base. The fork pocket distance defined between the pair of fork tunnel assemblies is configurable between a first fork pocket distance and a second fork pocket distance. The first fork pocket distance being greater than the second fork pocket distance.

In one aspect, the present invention provides a fork tunnel assembly for a modular shipping container. The modular shipping container defines a central axis and includes a base frame having a first end rail, a second end rail, a first side rail, and a second side rail, and a floor supported by the base frame. The fork tunnel assembly includes a fork tunnel and a pair of attachment plates attached to opposing ends of the fork tunnel. Each attachment plate is configured to be removably coupled to one of the first side rail and the second side rail. A fork pocket distance defined between the central axis and the fork tunnel is configurable between a first fork pocket distance and a second fork pocket distance. The first fork pocket distance being greater than the second fork pocket distance.

In another aspect, the present invention provides a roof for a modular shipping container. The modular shipping container includes a first end wall, a second end wall, a first side wall, and a second side wall. The roof includes a roof sheet having a top surface and defining a first end, a second end, a first side, and a second side. The roof further includes a pair of skid plate assembles. One of the pair of skid plate assembles is arranged along the first side of the roof sheet, and the other of the pair of skid plate assemblies is arranged along the second side of the roof sheet. The pair of skid plate assemblies partially extend over the top surface of the roof sheet. The roof sheet is formed of a unitary piece of material.

In one aspect, the present invention provides a modular shipping container including a base, a first end wall, a second end wall, a first side wall, a second side wall, and a roof removably coupled to each of the first end wall, the second end wall, the first side wall, and the second side wall. The roof includes a roof sheet having a top surface and defining a first end, a second end, a first side, and a second side. The roof further includes a pair of skid plate assembles. One of the pair of skid plate assembles is arranged along the first side of the roof sheet, and the other of the pair of skid plate assemblies is arranged along the second side of the roof sheet. The pair of skid plate assemblies partially extend over the top surface of the roof sheet. The roof sheet is formed of a unitary piece of material.

In another aspect, the present invention provides a side wall assembly for a modular shipping container. The modular shipping container includes a base and a side wall. The side wall assembly includes a tube hinge and a first hinge pin assembly having a first hinge pin extending therefrom. The first hinge pin is configured to be received within a first end of the tube hinge. The side wall assembly further includes a second hinge pin assembly having a second hinge pin extending therefrom. The second hinge pin is configured to be received within a second end of the tube hinge opposite the first end. The tube hinge, the first hinge pin assembly, and the second hinge pin assembly are configured to enable the side wall to pivotally rotate with respect to the base.

In one aspect, the present invention provides a modular shipping container including a base, a first end wall, a second end wall, a first side wall having a first side tube hinge coupled to a bottom end thereof, and a second side wall having a second side tube hinge coupled to a bottom end thereof. The modular shipping container further includes a first pair of hinge pin assemblies each configured to engage the first side tube hinge to pivotally couple the first side wall to the base. The modular shipping container further includes a second pair of hinge pin assemblies each configured to engage the second side tube hinge to pivotally couple the second side wall to the base.

In another aspect, the present invention provides a stacking bracket assembly for securing a plurality of modular shipping containers in a stacked arrangement. The stacking bracket assembly includes a plurality of stacking brackets each having a vertical stacking tube and a horizontal stacking tube. Each horizontal stacking tube is dimensioned to be received within one of a plurality of stacking tubes extending from one of the plurality of modular shipping containers. Each vertical stacking tube is dimensioned to receive a stacking adapter to couple an end of one of the plurality of stacking brackets to an opposing end of an adjacent one of the plurality of stacking brackets.

DETAILED DESCRIPTION

Figure 1:
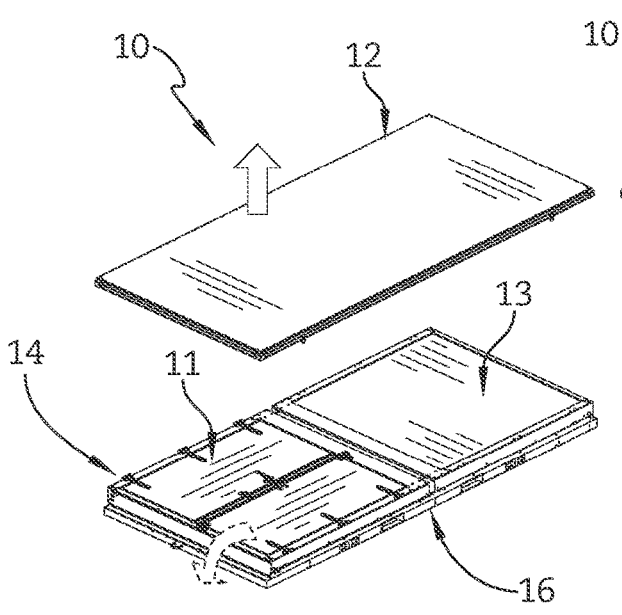
FIG. 1 is a partially exploded top, front, left isometric view of a modular shipping container in a disassembled state according to one aspect of the present disclosure.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 4:
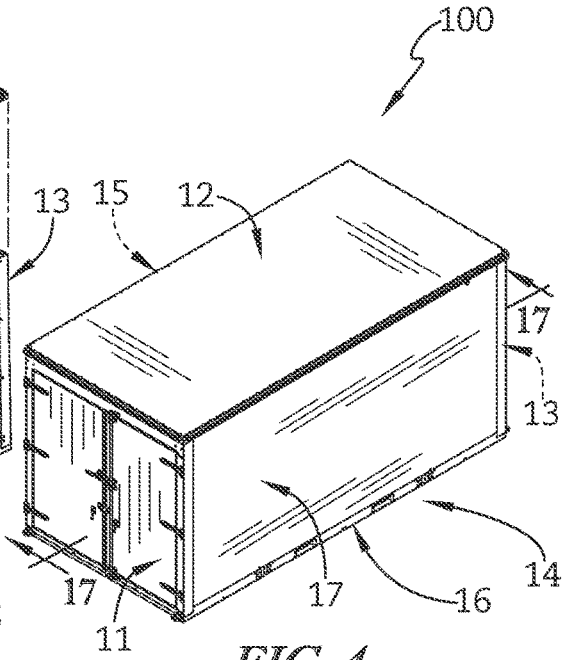
FIG. 4 is a top, front, left isometric view of the modular shipping container of FIG. 1 in an assembled state.

FIG. 1 illustrates a modular shipping container 10 according to one aspect of the present disclosure. The modular shipping container 10 includes a roof 12 and body 14. The roof 12 is positioned on body 14 for transportation of the modular shipping container 10 to a user. A profile of the modular shipping container 10 is smaller in a disassembled state (FIG. 1) when compared to a profile of the modular shipping container 10 in an assembled state (FIG. 4). As such, multiple modular shipping containers 10 may be stacked onto one another and transported to a user for final assembly.

Figure 2:
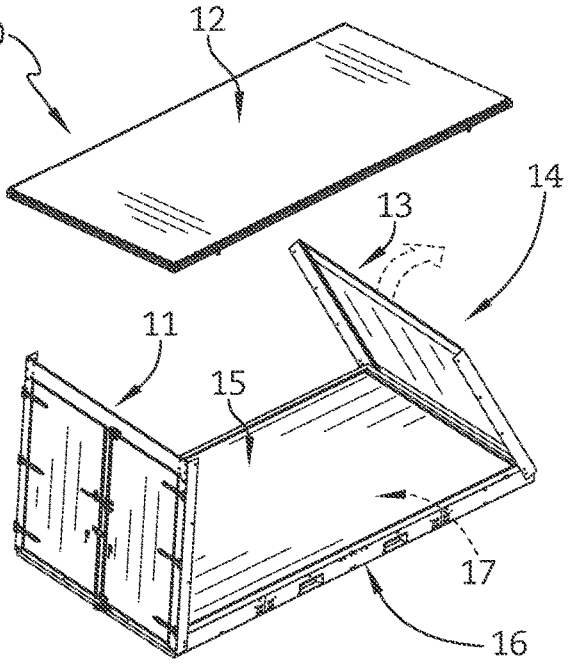
FIG. 2 is a partially exploded top, front, left, isometric view of the modular shipping container of FIG. 1 in a partially assembled state with a pair of end walls partially erected.

The body 14 includes a floor 16, a front wall 11 coupled to floor 16, and a rear wall 13 coupled to floor 16, as illustrated in FIG. 1. The front and rear walls 11, 13 are shown in a flattened transport position. To assemble the modular shipping container 10, a user removes roof 12 from body 14, as illustrated in FIG. 1. The user then pivots front wall 11 and rear wall 13 relative to floor 16 from the flattened transport position to an erected support position, as illustrated in FIG. 2.

Figure 3:
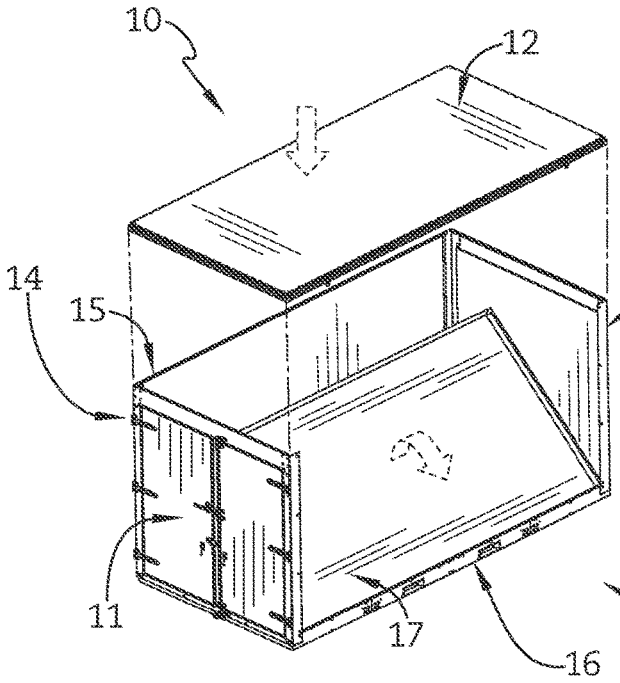
FIG. 3 is a partially exploded top, front, left isometric view of the modular shipping container of FIG. 1 in a partially assembled state with a pair of end walls and a side wall erected, and another side wall pivoted.

The body 14 also includes a left side wall 15 and a right side wall 17 coupled to floor 16, as illustrated in FIG. 3. The user pivots left side wall 15 from a flattened transport position, illustrated in FIG. 2, to an erected support position, illustrated in FIG. 3. The user also pivots the right side wall 17 to an erected support position as illustrated in FIG. 3. In the illustrative embodiment, the left and the right side walls 15, 17 are stored beneath the front and the rear walls 11, 13 in the flattened transport position. The roof 12 is coupled to body 14 at upper edges of the walls 11, 13, 15, 17 to form the assembled modular shipping container, as illustrated in FIG. 4.

In the illustrative embodiment, the front wall 11 and the rear wall 13 are substantially similar except that that front wall 11 includes doors for accessing an interior space within the assembled modular shipping container, as illustrated in FIG. 1. In the illustrative embodiment, the left wall 15 and the right wall 17 are also substantially similar in construction. As such, the discussion below of the rear wall 13 also applied to the front wall 11, and the discussion below of the left side wall 15 also applies to the right side wall 17. However, it should be noted that, in some embodiments, the walls 11, 13, 15, 17 may have varying constructions and configurations relative to one another, as desired.

Figure 5:
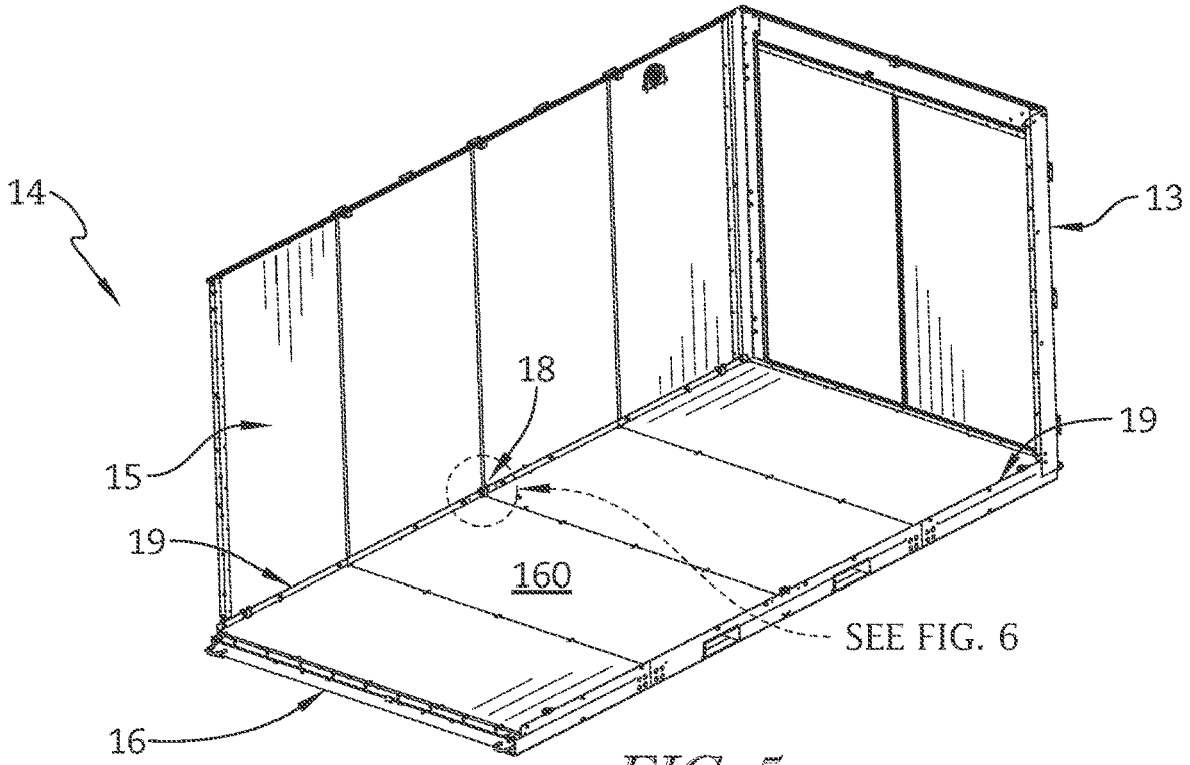
FIG. 5 is a top, front, left isometric view of the modular shipping container of FIG. 4 with a roof, a side wall, and an end wall removed.
Figure 6:
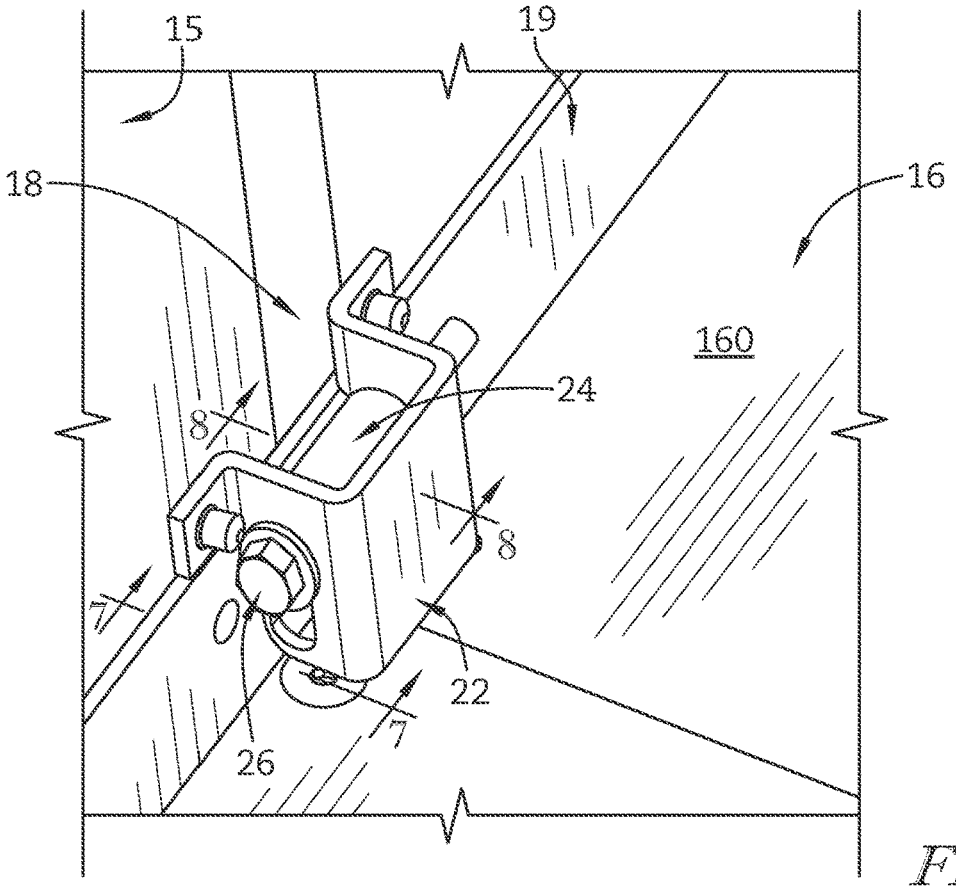
FIG. 6 is a magnified view of a sliding hinge of the modular shipping container of FIG. 5.

As shown in FIG. 5, the floor 16 includes a deck 160 and a pair of side rails 19 that extend upward from the deck 160 and alongside a periphery thereof. A sliding hinge 18 in accordance with the present disclosure secures left side wall 15 with floor 16, as shown in FIGS. 5 and 6. The sliding hinge 18 is coupled to left side wall 15 and side rail 19 to secure the left side wall 15 to the floor 16. In the illustrative embodiment, multiple sliding hinges 18 are used to secure the left side wall 15 to the floor 16.

Figure 7:
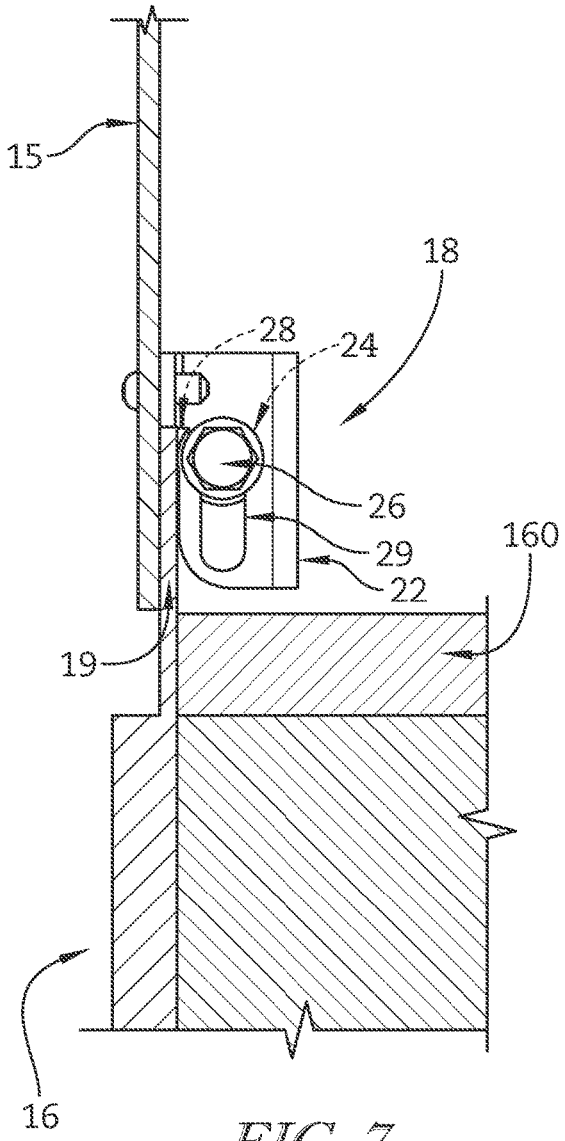
FIG. 7 is a cross-sectional view of the sliding hinge of FIG. 6 taken generally along the line 7-7 of FIG. 6.
Figure 8:
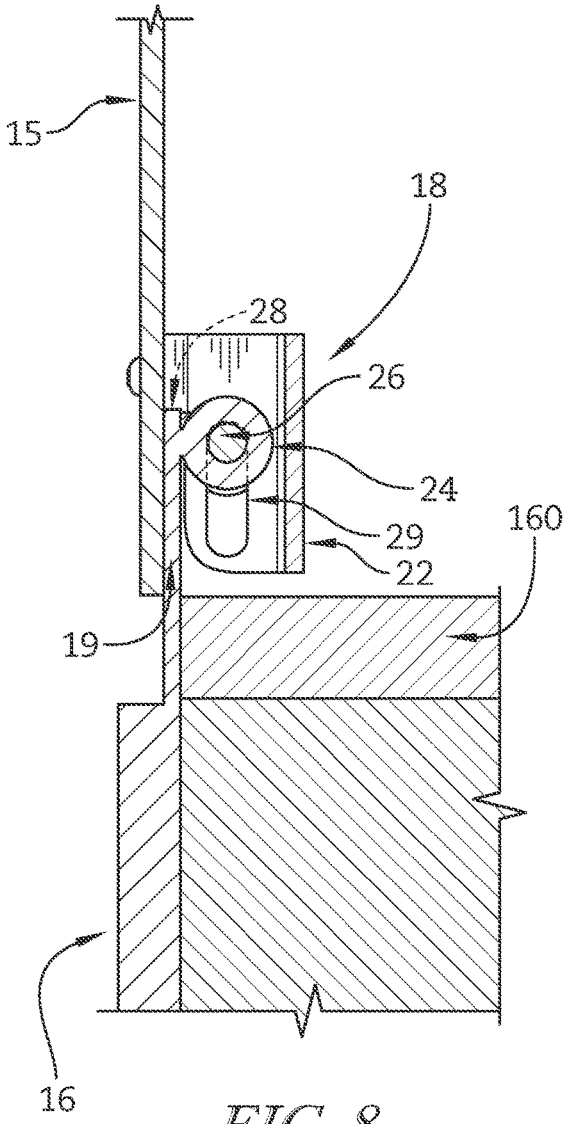
FIG. 8 is a cross-sectional view of the sliding hinge of FIG. 6 taken generally along the line 8-8 of FIG. 6.

The sliding hinge 18 includes a bracket 22 coupled to the left side wall 15, a sleeve 24 positioned within the bracket 22 and coupled to the side rail 19 of the floor 16, and a fastener 26 extending through the bracket 22 and the sleeve 24, as illustrated in FIG. 6. The bracket 22 is formed to include a slot 29 which receives the fastener 26, as illustrated in FIGS. 7 and 8. In the illustrative embodiment, the fastener 26 is in the form of a bolt. In some embodiments, other fasteners may be used, for example, pins. An upper portion of the bracket 22 is secured to the left side wall 15 and a lower portion of the bracket 22 is spaced apart from the left side wall 15 to define a gap 28 therebetween. The gap 28 is configured to receive a portion of the side rail 19 to align the left side wall 15 with the floor 16 in the erected support position. The sleeve 24 is secured to the side rail 19, as illustrated in FIG. 8. In some embodiments, the sleeve 24 is welded to the side rail 19.

Figure 9:
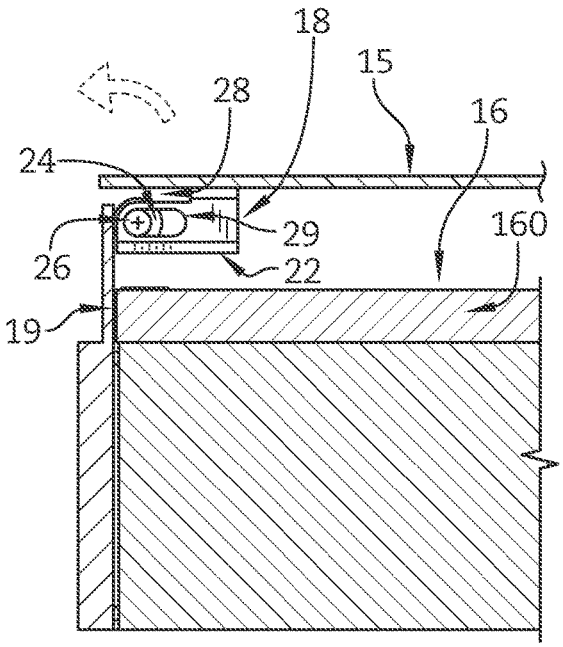
FIG. 9 is a schematic illustration of the sliding hinge of FIG. 7 in a disassembled state.
Figure 10:
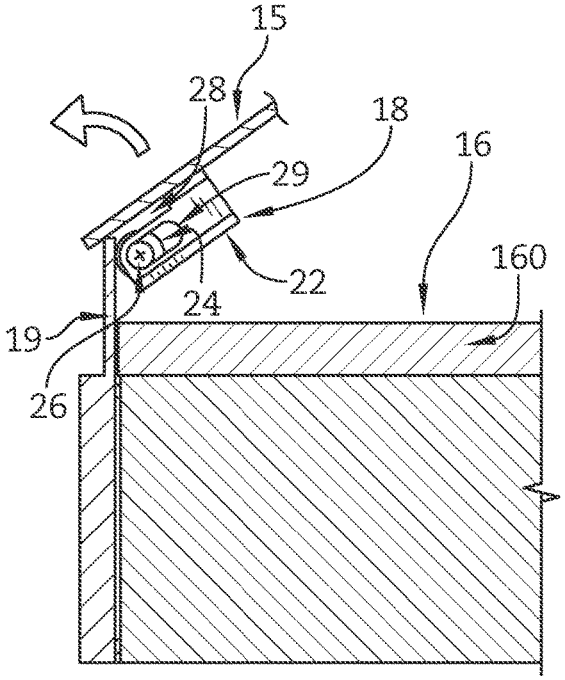
FIG. 10 is a schematic illustration of the sliding hinge of FIG. 7 in a partially assembled state with a side wall pivoting about the sliding hinge.
Figure 11:
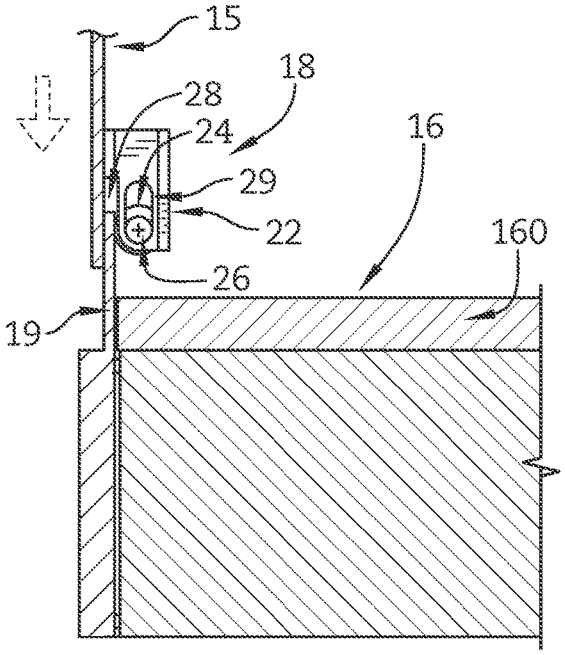
FIG. 11 is a schematic illustration of the sliding hinge of FIG. 7 in a partially assembled state with a side wall erected and unfastened.
Figure 12:
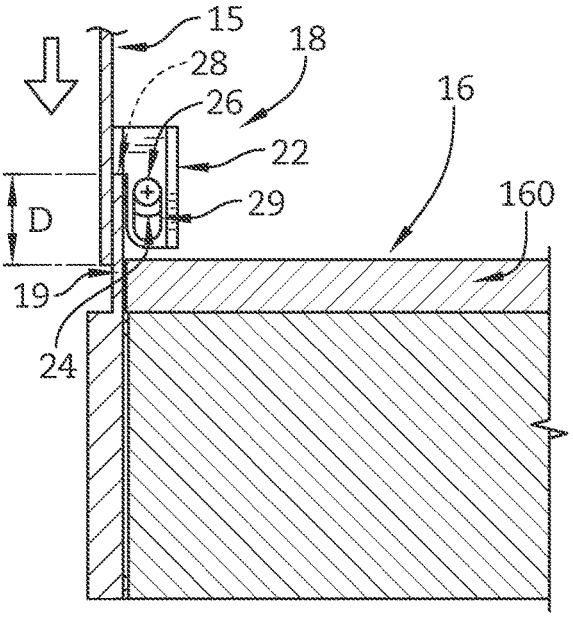
FIG. 12 is a schematic illustration of the sliding hinge of FIG. 7 in an assembled state with a side wall erected and fastened.

As illustrated in FIG. 9, the fastener 26 contacts an end of the slot 29 to allow the left side wall 15 to pivot relative to the floor 16. As the left side wall 15 pivots, a lower portion of the left side wall 15 passes over the side rail 19, as illustrated in FIG. 10. The left side wall 15 is pivoted until the side rail 19 is substantially aligned with the gap 28, as illustrated in FIG. 11. The left side wall 15 is lowered until the fastener 26 engages the other end of the slot 29 and the side rail 19 is received in the gap 28, as illustrated in FIG. 12. The left side wall 15 overlaps with the side rail 19 by a distance D to resist the entry of water, such as from rain, or other liquids into the assembled modular shipping container 10.

Skilled workers may not be required to be on-site to assemble the modular shipping container 10 due to the secure connections between the walls 11, 13, 15, 17 and the floor 16. For example, the sliding hinge 18 can be installed at a manufacturing facility of the modular shipping container 10 such that the left and the right side walls 15, 17 are properly aligned with floor 16 when in the erected support position. Similarly, the front and the rear walls 11, 13 may be attached and properly aligned with the floor 16 at the manufacturing facility. No subsequent alignment of the walls 11, 13, 15, 17 may be required. As such, a user simply has to pivot the walls 11, 13, 15, 17 into the erected support position and attach the roof 12 to the body 14 to assemble the modular shipping container 10. In some embodiments, the modular shipping container 10 is delivered to a user with the fasteners 26 removed from sliding hinges 18. In such an embodiment, the user aligns the brackets 22 with the sleeves 24 to insert the fasteners 26. No additional alignment may be necessary because the sliding hinges 18 may be aligned prior to delivery of the modular shipping container 10 to the user.

Figure 13:
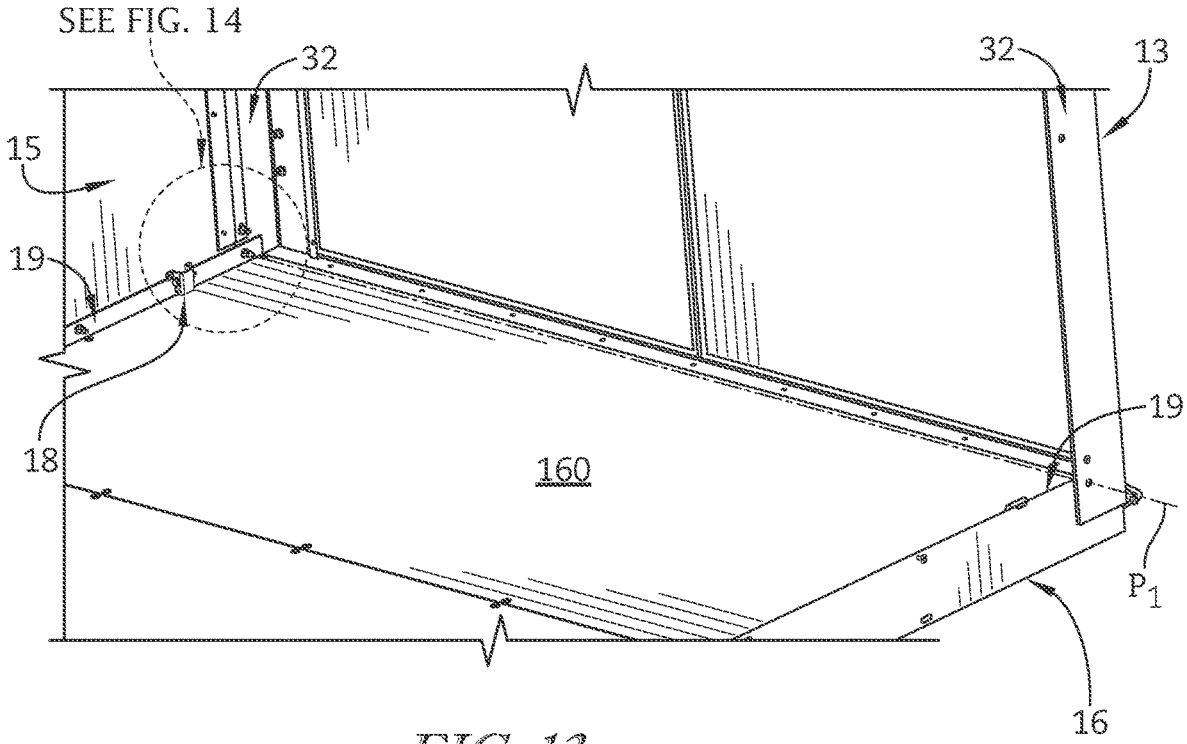
FIG. 13 is an magnified view of a portion of the modular shipping container of FIG. 5.
Figure 14:
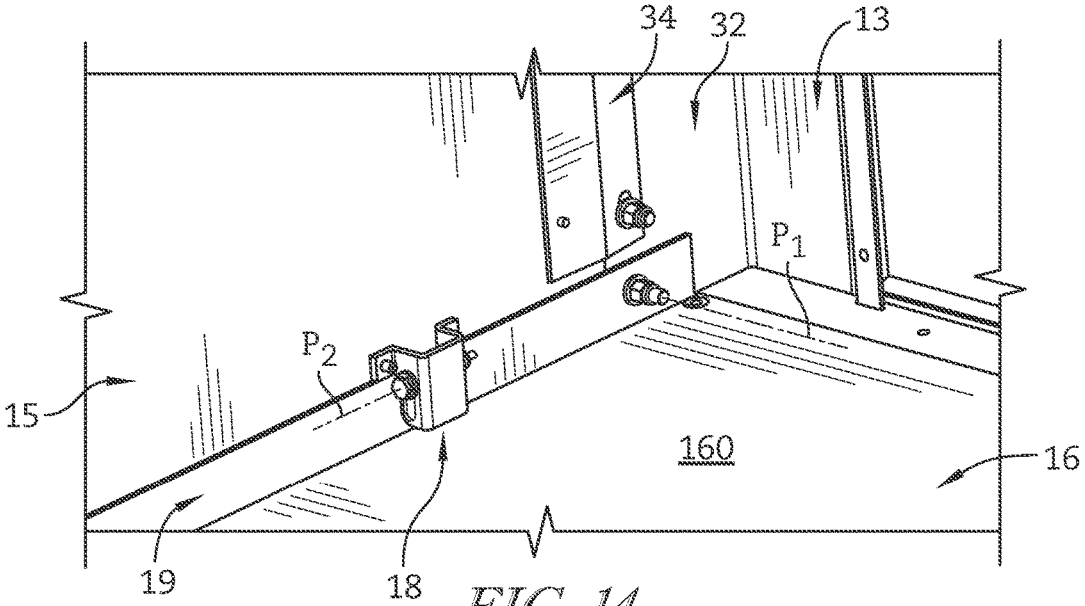
FIG. 14 is a magnified view of a retainer flange coupled to an end wall of the modular shipping container of FIG. 13.

The rear wall 13 includes a pair of retainer flanges 32, as illustrated in FIG. 13. The retainer flanges 32 are coupled to the side rails 19 to allow the rear wall 13 to pivot about a pivot axis $P_1$ relative to the floor 16, as illustrated in FIGS. 13 and 14. The sliding hinge 18 is configured to allow the left side wall 15 to pivot about a pivot axis $P_2$ relative to the floor 16, as illustrated in FIG. 14. The pivot axis $P_1$ is generally perpendicular to pivot axis $P_2$. In the illustrative embodiment, a lock plate 34 is coupled between the retainer flange 32 and the left side wall 15 to maintain the left side wall 15 and the rear wall 13 in the erected support position.

Figure 15:
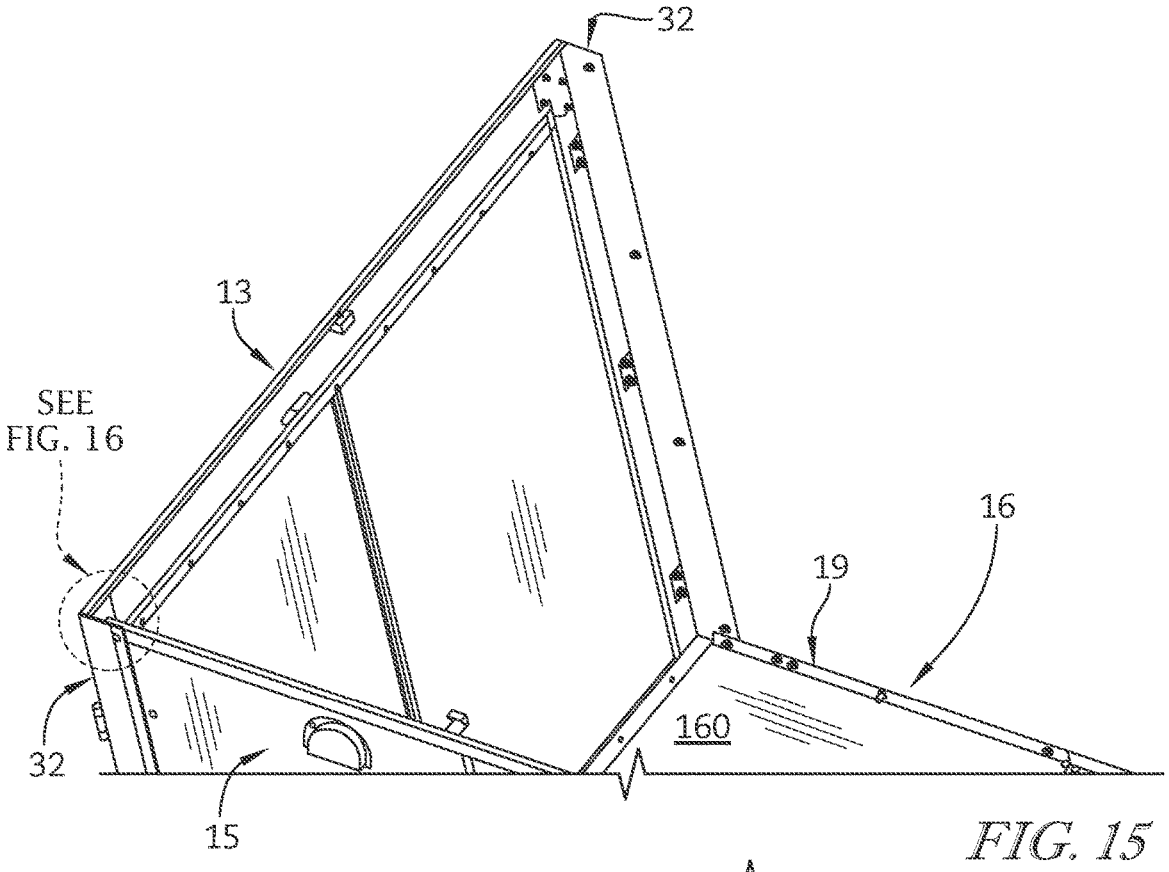
FIG. 15 is a partial top, rear, left isometric view of the modular shipping container of FIG. 5.
Figure 16:
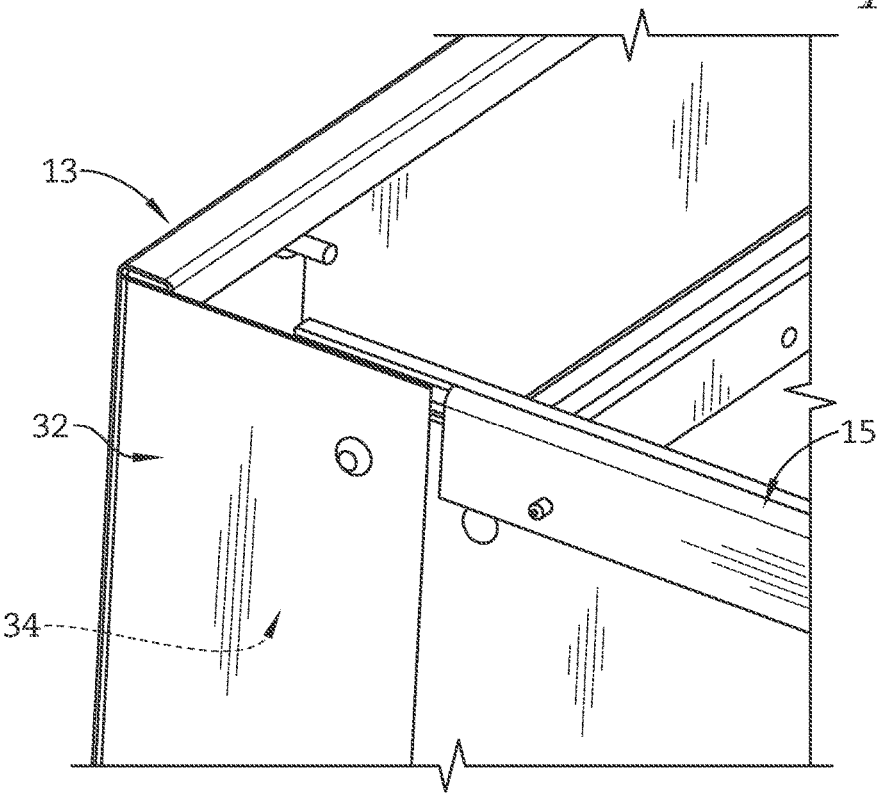
FIG. 16 is a magnified view of a retainer flange coupled to an end wall of the modular shipping container of FIG. 15.

The retainer flange 32 is positioned to engage with the left side wall 15 when the left side wall 15 is moved to the erected support position, as illustrated in FIGS. 15 and 16. The retainer flange 32 overlaps the left side wall 15 to resist the entry of water, such as from rain, or other liquids into the modular shipping container 10, when assembled. The left side wall 15 engages with the retainer flange 32 to form a continuous side of the modular shipping container 10.

In some embodiments, the front and the rear walls 11, 13 are removed from the floor 16 prior to delivery of the modular shipping container 10 to a user. In such an embodiment, the user aligns the front and the rear walls 11, 13 with the floor 16 and inserts fasteners through the retainer flanges 32 and the side rails 19 to secure the front and the rear walls 11, 13 to the floor 16. Holes for receiving the fasteners are formed in the side rails 19 and the retainer flanges 32 prior to delivery to the user. As such, no skilled workers may be necessary to align the front and the rear walls 11, 13 with the floor 16. In some embodiments, the front and the rear walls 11, 13 are secured to the floor 16 by sliding hinges.

Figure 17:
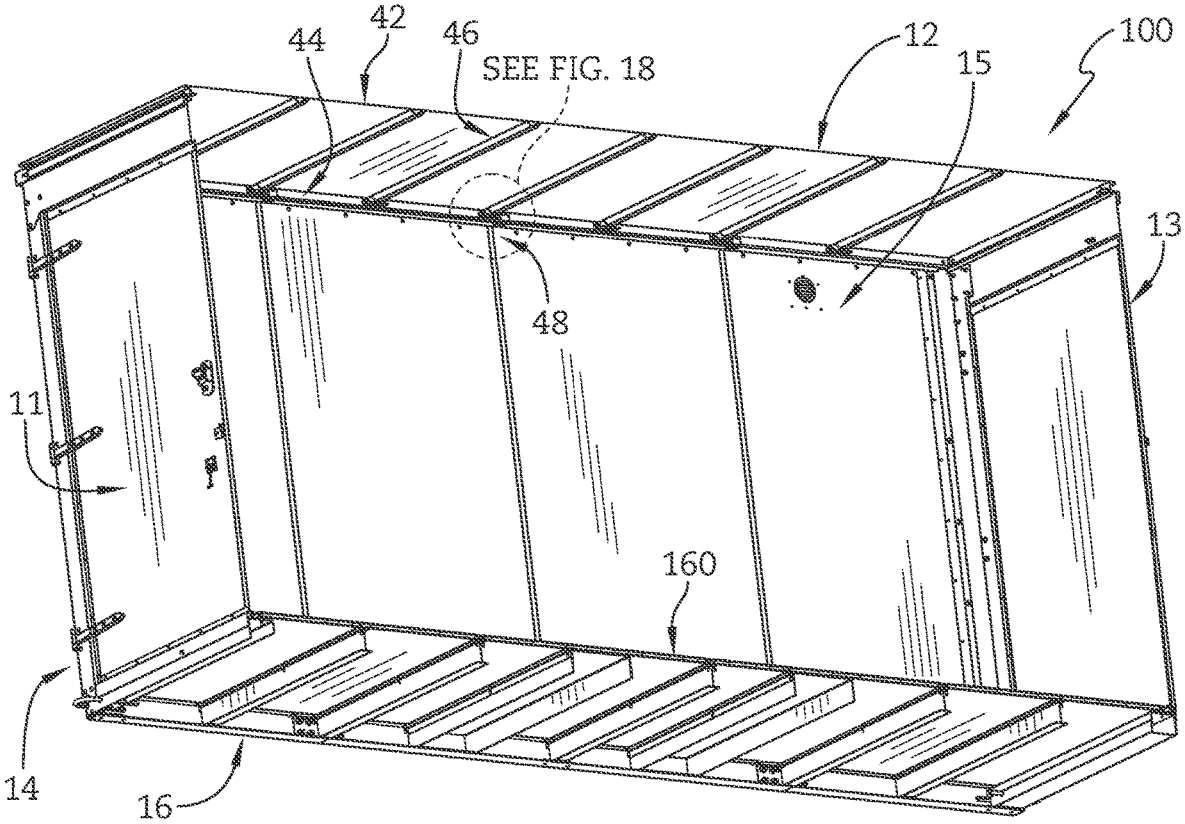
FIG. 17 is cross-sectional bottom, front, left isometric view of the modular shipping container of FIG. 4 taken generally along the line 17-17 of FIG. 4.
Figure 18:
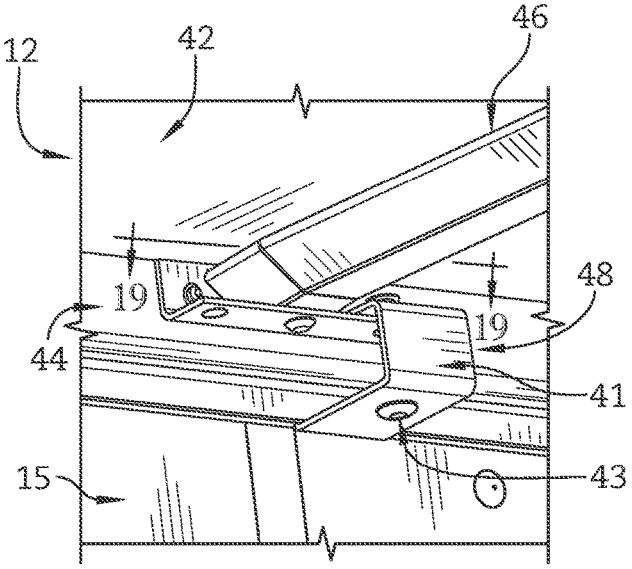
FIG. 18 is a magnified view of a clamp of the modular shipping container of FIG. 17.
Figure 19:
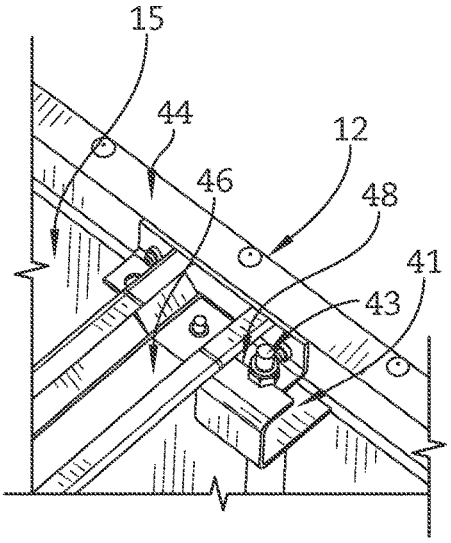
FIG. 19 is a cross-sectional view of the clamp of the modular shipping container of FIG. 18 taken generally along the line 19-19 of FIG. 18.

The roof 12 includes a panel 42, a perimeter frame 44, and a plurality of support ribs 46 coupled to the perimeter frame 44 to support the panel 42, as illustrated in FIG. 17. One or more clamps 48 secure the roof 12 to the body 14. Each clamp 48 includes a J-shaped channel 41, engaged with the support rib 46 and an upper edge of the walls 11, 13, 15, 17, and a fastener 43 (e.g., a bolt), extending through the support rib 46 and the J-shaped channel 41, as illustrated in FIGS. 18 and 19.

In illustrative embodiments, a sliding hinge mounts to the bottom of a container side wall allowing for easy field assembly of a shipping container. The sliding hinge allows the side walls to be shipped in a folded position to increase the number of units that can be transported at a time. On site, the sliding hinge allows for the easy erection of the walls and aligns the walls in their final position. The sliding of the hinge allows the folded walls to sit inside the base (floor) frame and folded end walls. The sliding hinge also allows overlap of the side walls over the base frame in the assembled position to assist in water shedding.

In illustrative embodiments, the sliding hinge reduces the total shipping height of a modular shipping container in a disassembled, or shipping ready, state. The sliding hinge decreases the potential for water penetration into the container by increasing the water shedding abilities of the side walls. The sliding hinge increases the assembly ease of the final shipping container by aligning the side walls in their final position.

Figure 20:
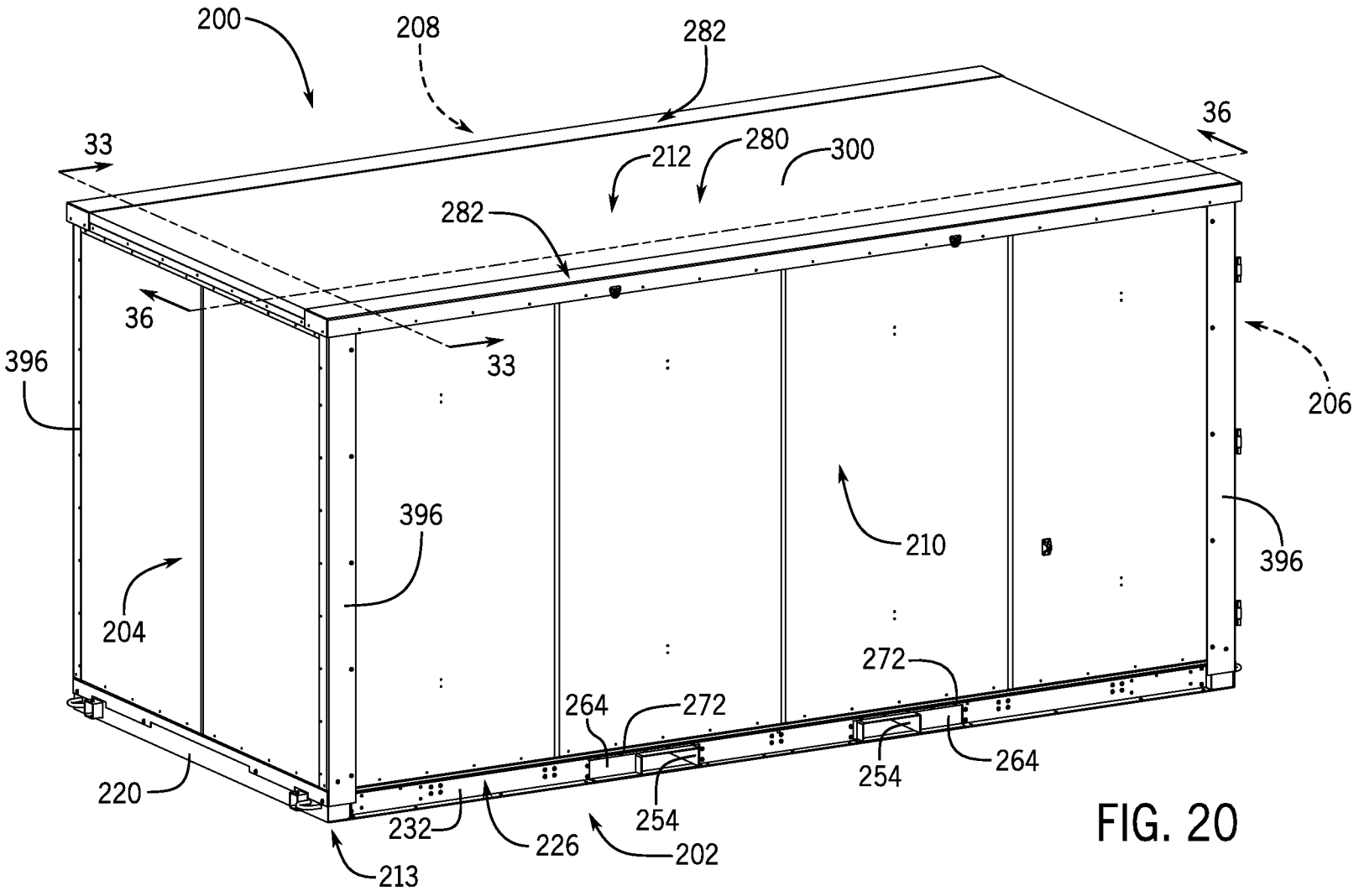
FIG. 20 is a top, front, left isometric view of a modular shipping container according to another aspect of the present disclosure.
Figure 21:
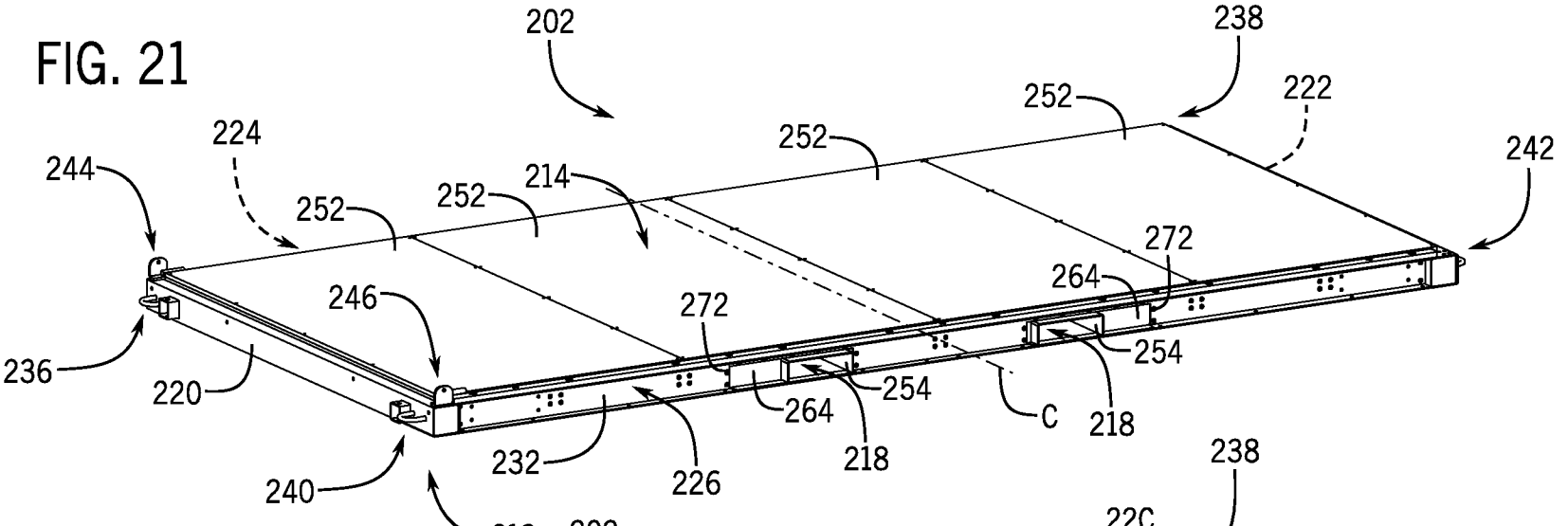
FIG. 21 is a top, front, left isometric view of a base of the modular shipping container of FIG. 20.
Figure 22A:
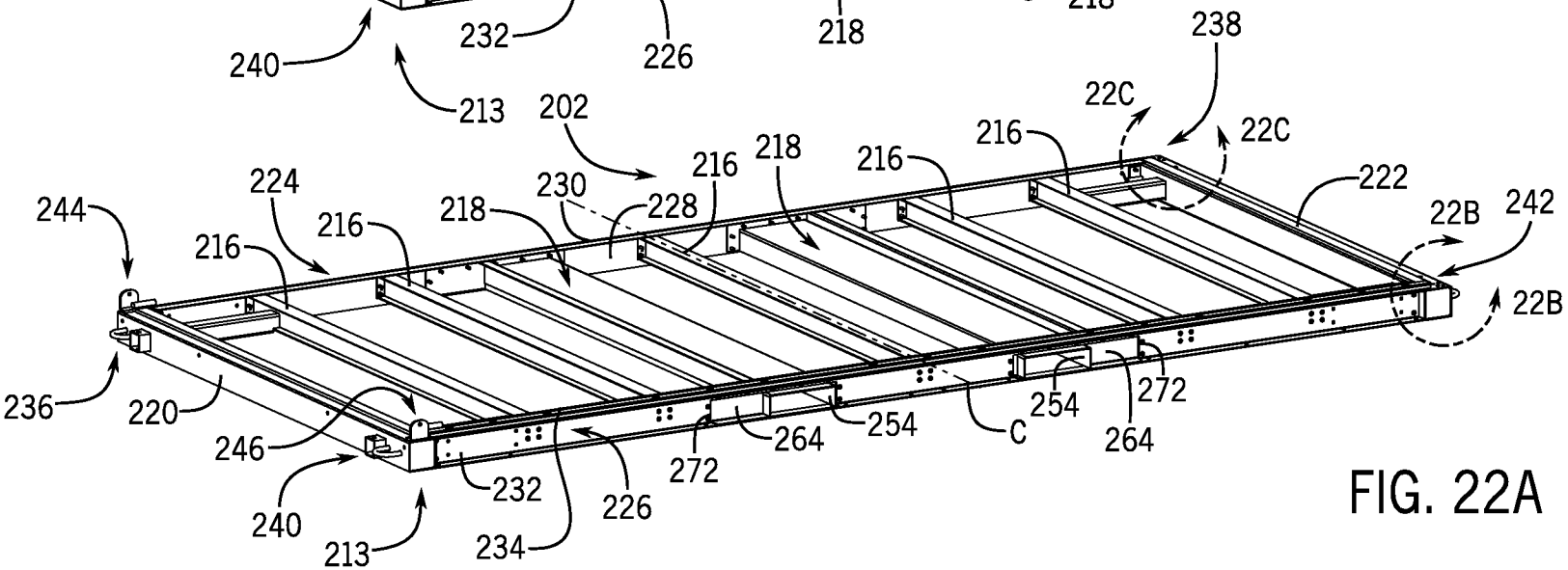
FIG. 22A is a top, front, left isometric view of a base of the modular shipping container of FIG. 20 with a floor removed from the base.
Figure 22B:
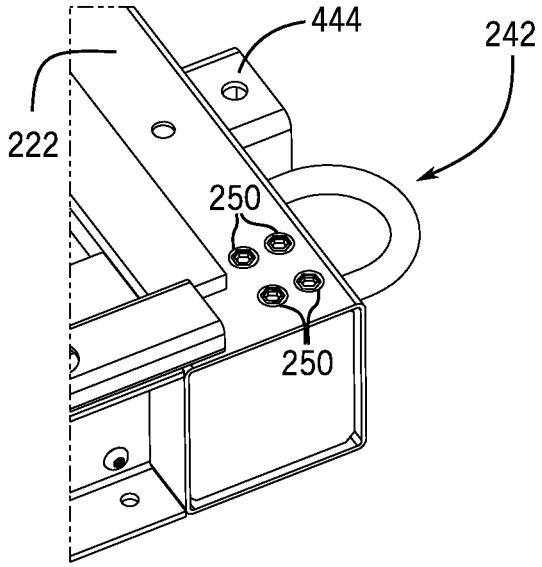
FIG. 22B is a magnified view of a portion of FIG. 22A.
Figure 22C:
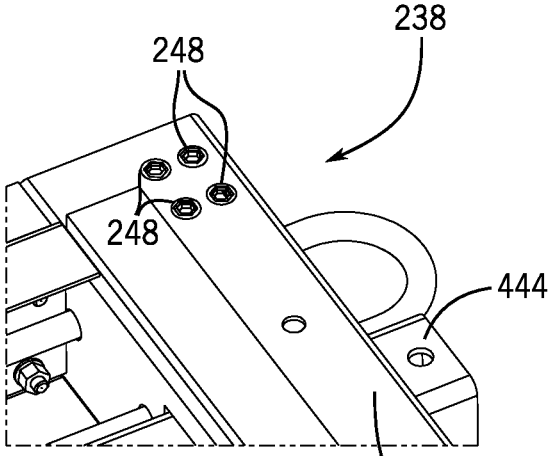
FIG. 22C is a magnified view of another portion of FIG. 22A.

FIG. 20 illustrates a modular shipping container 200 according to another aspect of the present disclosure. The modular shipping container 200 includes a base 202, a first end wall 204, a second end wall 206, a first side wall 208, a second side wall 210, and a roof 212. As will be described, each of the first side wall 208 and the second side wall 210 are pivotally coupled to the base 202 to enable the modular shipping container 200 to be easily assembled and disassembled. In the illustrated embodiment of FIG. 20, the first end wall 204 and the second end wall 206 define a generally shorter length than the first side wall 208 and the second side wall 210. As such, the illustrated modular shipping container 200 defines a generally rectangular prism shape. In other embodiments, for example, the size of the first and second end walls 204 and 206 relative to the first and second side walls 208 and 210 may vary to define alternative shapes of the modular shipping container 200.

FIGS. 21 and 22A-C illustrate the base 202 of the modular shipping container 200. The base 202 includes a base frame 213, a floor 214, a plurality of support beams 216, and a pair of fork tunnel assemblies 218. The base frame 213 includes a first end rail 220, a second end rail 222, a first side rail 224, and a second side rail 226. The illustrated base 202 can define a generally rectangular shape. That is, the first and second end rails 220 and 222 define a shorter length than the first and second side rails 224 and 226. The first side rail 224 includes a first inner rail 228 and a first outer rail 230 coupled to the first inner rail 228. Similarly, the second side rail 226 includes a second inner rail 232 and a second outer rail 234 coupled to the second inner rail 232.

The first side rail 224 is attached to the first end rail 220 adjacent to a distal end 236 thereof and is coupled to the second end rail 222 adjacent to a distal end 238 thereof. The second side rail 226 is coupled to the first end rail 220 adjacent to an opposing distal end 240 thereof, and is coupled to the second end rail 222 at opposing distal end 242 thereof. The base frame 213 forms a periphery of the generally rectangular shape defined by the base 202.

The first end rail 220 includes a first stationary hinge pin assembly 244 coupled to the distal end 236 and a second stationary hinge pin assembly 246 coupled to the opposing distal end 240. The first and second stationary hinge pin assemblies 244 and 246 may be welded to the first end rail 220. In other embodiments, the first and second stationary hinge pin assemblies 244 and 246 may be coupled to the first end rail 220 via another attachment mechanism (e.g., an adhesive, one or more fasteners, etc.). The second end rail 222 includes a plurality of first hinge apertures 248 formed within the distal end 238 and a plurality of second hinge apertures 250 formed within the distal end 242.

In some embodiments, the distal ends 236, 238, 240, and 242 may define the corners of the periphery formed by the base frame 213. Thus, the base frame 213 includes the first and second stationary hinge pin assemblies 244 and 246 coupled to adjacent corners thereof, and includes the plurality of first and second hinge apertures 248 and 250 arranged on longitudinally opposing adjacent corners thereof.

Still referring to FIGS. 21 and 22A-22C, the floor 214 is supported by the base frame 213 and coupled thereto. The illustrated floor 214 is formed by a plurality of panels 252 each fastened to the base frame 213, one or more of the plurality of support beams 216, and/or one of the pair of fork tunnel assemblies 218. In other embodiments, for example, the floor 214 may be formed as a unitary component. The floor 214 provides a surface on which items may be stored within the modular shipping container 200, when assembled.

Each of the plurality of support beams 216 is coupled to the first inner rail 228 and to the second inner rail 232, and extend therebetween. Each of the illustrated plurality of support beams 216 defines a generally I-beam shape in cross-section. In other embodiments, for example, the plurality of support beams 216 may define an alternative shape, as desired. The illustrated base 202 includes five support beams 216, with two arranged on each opposing side of the pair of fork tunnel assemblies 218 and one arranged between the pair of fork tunnel assemblies 218. In other embodiments, for example, the base 202 may include more or less than five support beams 216 in any arrangement along the base 202.

Each of the pair of fork tunnel assemblies 218 is in engagement with the first inner rail 228 and the second inner rail 232, and extend therebetween. The fork tunnel assemblies 218 are arranged symmetrically about a central axis C defined by the base 202 such that a predefined distance exists therebetween. As will be described below, the fork tunnel assemblies 218 are removably coupled to the base frame 213 to enable the predefined distance defined between the pair of fork tunnel assemblies 218 to be configurable.

Figure 23:
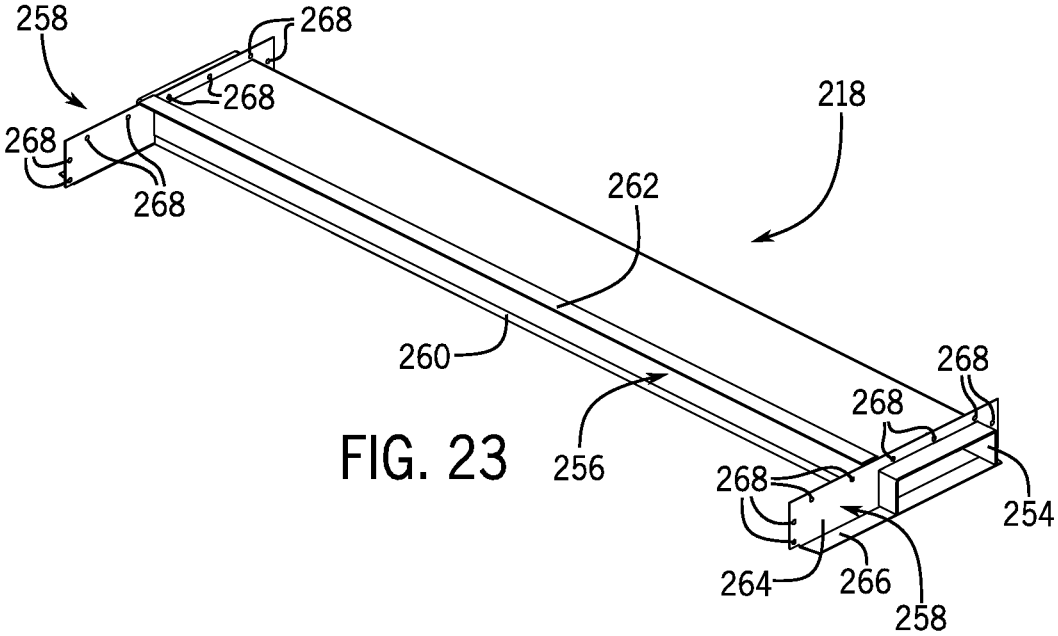
FIG. 23 is a top, front, left isometric view of a fork tunnel assembly of the modular shipping container of FIG. 20.
Figure 24:
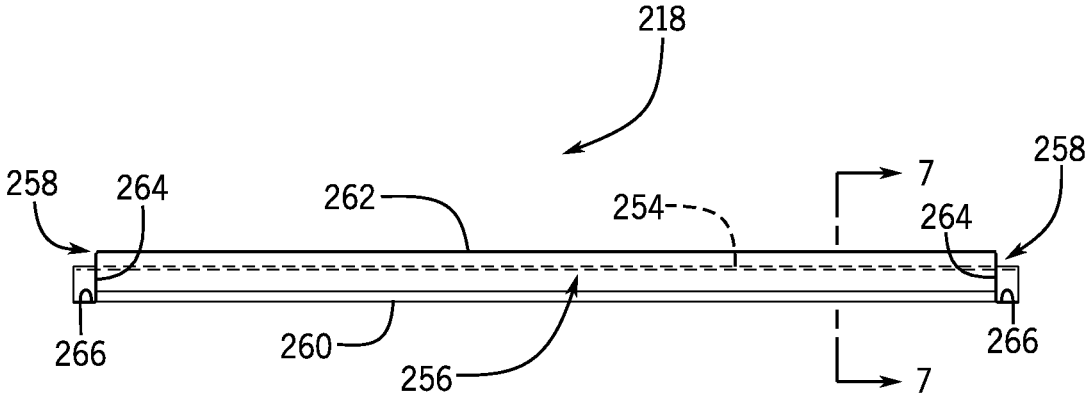
FIG. 24 is a left side view of the fork tunnel assembly of FIG. 23.
Figure 25:
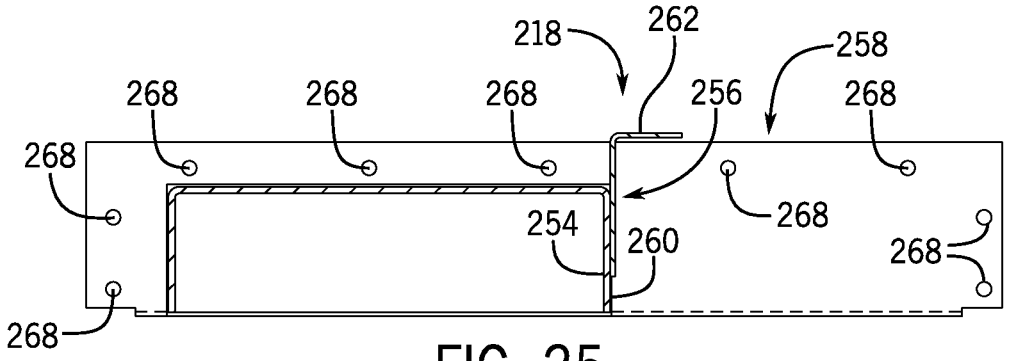
FIG. 25 is a cross-sectional view of the fork tunnel assembly of FIG. 24 taken generally along the line 25-25 of FIG. 24.

The fork tunnel assemblies 218 are symmetric about a center axis C, therefore, the following description of one of the pair of the fork tunnel assemblies 218 applies symmetrically to the other of the pair of fork tunnel assemblies 218. Similar features between the pair of fork tunnel assemblies 218 are identified using like reference numerals. FIGS. 23-25 illustrate one of the pair of fork tunnel assemblies 218. The illustrated fork tunnel assembly 218 includes a fork tunnel 254, a support flange 256, and a pair of attachment plates 258. The fork tunnel 254 defines a generally rectangular tunnel, or slot, which extends longitudinally along the fork tunnel assembly 218. The fork tunnel 254 is dimensioned to receive a fork of a material handling vehicle to facilitate transportation of the modular shipping container 200.

The support flange 256 is attached to an outer surface 260 of the fork tunnel 254. The outer surface 260 is arranged adjacent to the central axis C, when the base 202 is assembled. The support flange 256 defines a generally L-shaped profile and includes a support surface 262. The support surface 262 is arranged substantially perpendicularly to the outer surface 260. The support flange 256 extends from the outer surface 260 such that the support surface 262 is disposed generally above the fork tunnel 254. That is, the support flange 256 extends above the outer surface 260 such that the support surface 262 engages a bottom surface of the floor 214, when the base 202 is assembled. In this manner, the floor 214 is partially supported by the support surface 262 and coupled thereto.

Each of the pair of attachment plates 258 is arranged on the respective opposing ends of the fork tunnel assembly 218 such that a portion of the fork tunnel 254 extends therethrough and protrudes therefrom. Each of the pair of attachment plates 258 includes a mounting surface 264 and an attachment plate flange 266 extending substantially perpendicularly from a bottom end of the mounting surface 264. Each of the mounting surfaces 264 includes a plurality of tunnel mounting apertures 268 arranged around a periphery thereof for coupling the mounting surfaces 264 to the base frame 213, as will be discussed immediately below.

Turning to FIGS. 26A-27B, the first side rail 224 includes a pair of first fork tunnel cutouts 270. Similarly, the second side rail 226 includes a pair of second fork tunnel cutouts 272. Each of the pair of first fork tunnel cutouts 270 and the pair of second fork tunnel cutouts 272 includes a plurality of cutout mounting apertures 274 arranged around a periphery thereof. Each of the plurality of cutout mounting apertures 274 is arranged such that they align with the plurality of tunnel mounting apertures 268 on a corresponding one of the mounting surfaces 264. A fastening element 276 is configured to be received within each of the plurality of cutout mounting apertures 274 and the corresponding one of the plurality of tunnel mounting apertures 268 aligned therewith. The fastening elements 276 removably couple each of the fork tunnel assemblies 218 to the base frame 213. In the illustrated embodiment, the fastening elements 276 removably couple each of the mounting surfaces 264 to a corresponding one of the first side rail 224 or the second side rail 226. The illustrated fastening elements 276 are each in the form of a bolt and a nut. In other embodiments, the fastening elements 276 may be in the form of another removable fastening mechanism (e.g., a pin, a clamp, a screw, etc.).

Each of the mounting surfaces 264 is dimensioned to cover a corresponding one of the first fork tunnel cutouts 270 or the second fork tunnel cutouts 272. As described above, the fork tunnels 254 protrude from the attachment plates 258, thus, when assembled, the mounting surfaces 264 cover the respective one of the first fork tunnel cutouts 270 or the second fork tunnel cutouts 272 except for the fork tunnels 254, which protrude therefrom. In this manner, when the fork tunnel assemblies 218 are installed on the base frame 213, the fork tunnels 254 define a predefined distance therebetween. Each of the fork tunnels 254 is configured to receive a fork of a material handling vehicle to enable transportation of the modular shipping container 200. The predefined distance defined between the fork tunnels 254 generally corresponds with a distance between the forks on a material handling vehicle (i.e., a fork pocket distance). Since a distance between the forks on a material handling vehicle may be different depending on the type of material handling vehicle utilized by a given end user, it would be desirable to have a modular shipping container with a configurable fork pocket distance. As will be described, the design and arrangement of the fork tunnel assemblies 218 enables the base 202 of the modular shipping container 200 to provide a configurable fork pocket distance. This ability to configure the fork pocket distance allows an end user to choose a fork pocket spacing to correspond with whichever fork pocket spacing is necessary for the specific material handling vehicle they utilize.

Figure 26A:
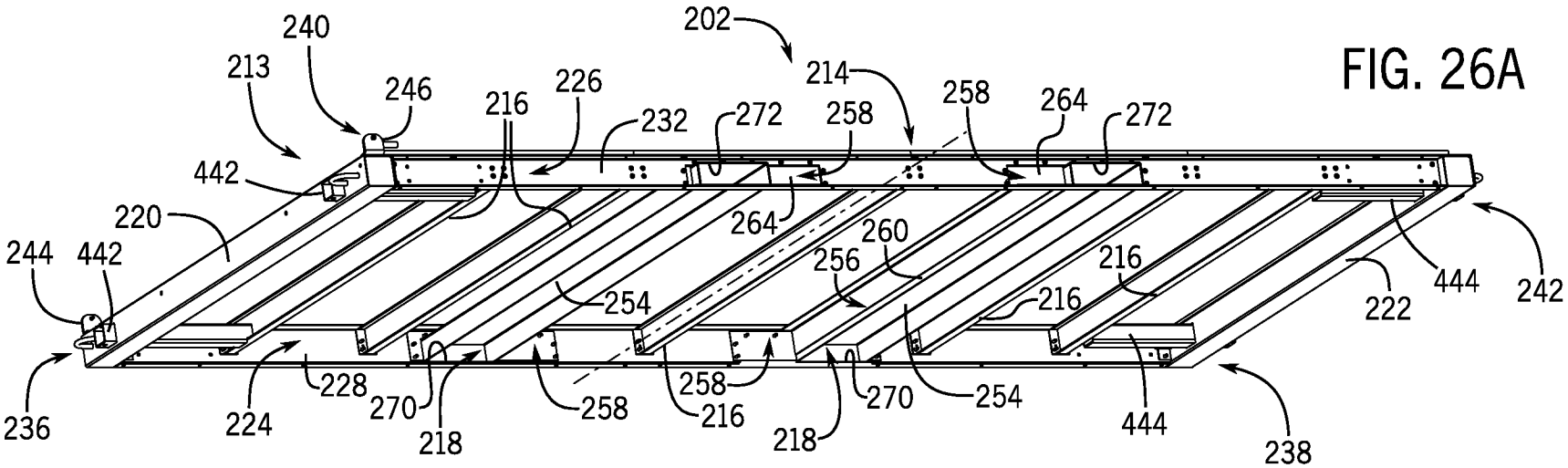
FIG. 26A is a bottom, front, left isometric view of the base of FIG. 22A with a pair of fork tunnel assemblies in a first configuration.
Figure 26B:
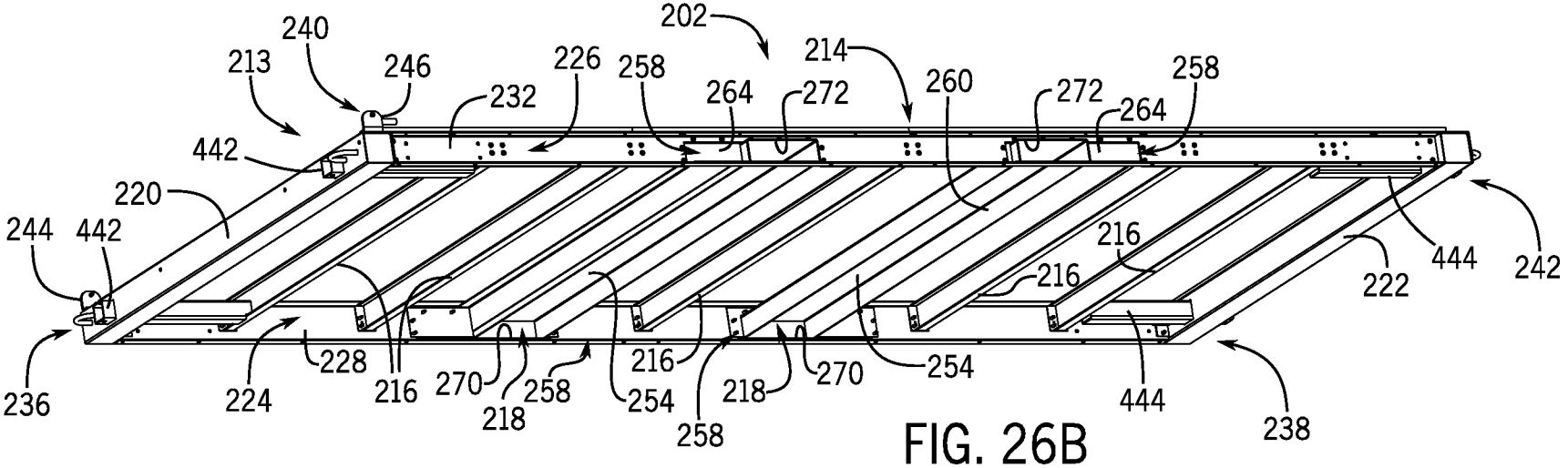
FIG. 26B is a bottom, front, left isometric view of the base of FIG. 22A with a pair of fork tunnel assemblies in a second configuration.
Figure 27A:
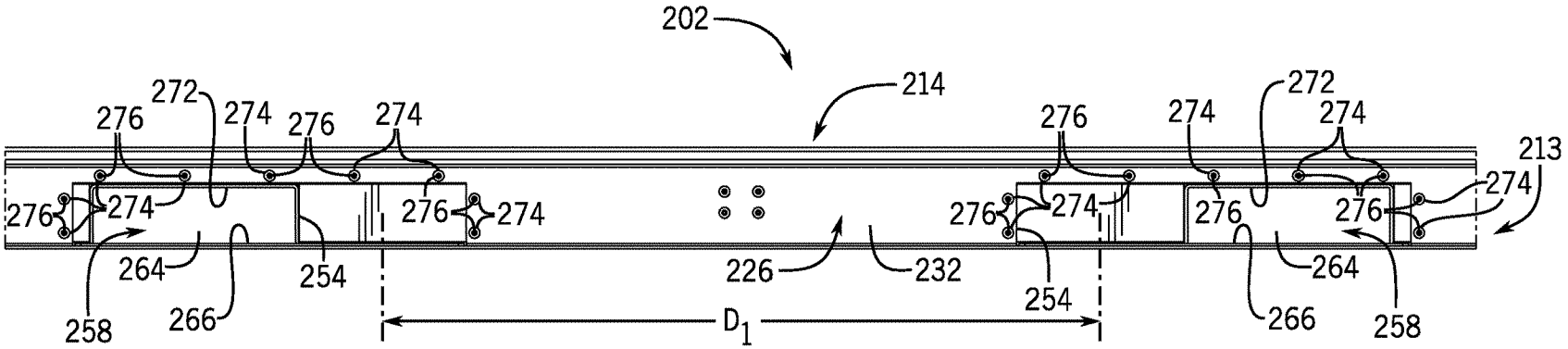
FIG. 27A is a front view of the base of FIG. 22A with a pair of fork tunnel assemblies in a first configuration.
Figure 27B:
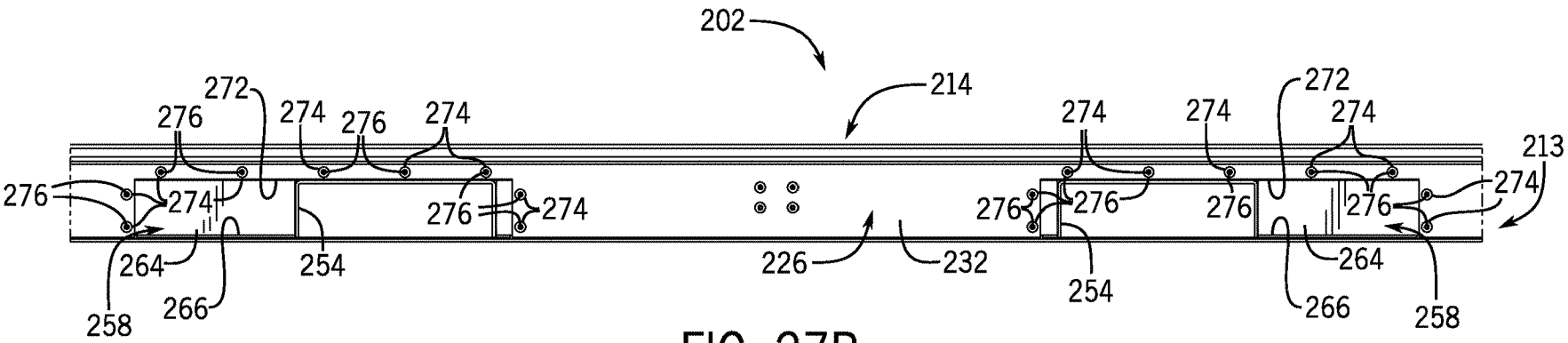
FIG. 27B is a front view of the base of FIG. 22A with a pair of fork tunnel assemblies in a second configuration.
Figure 28:
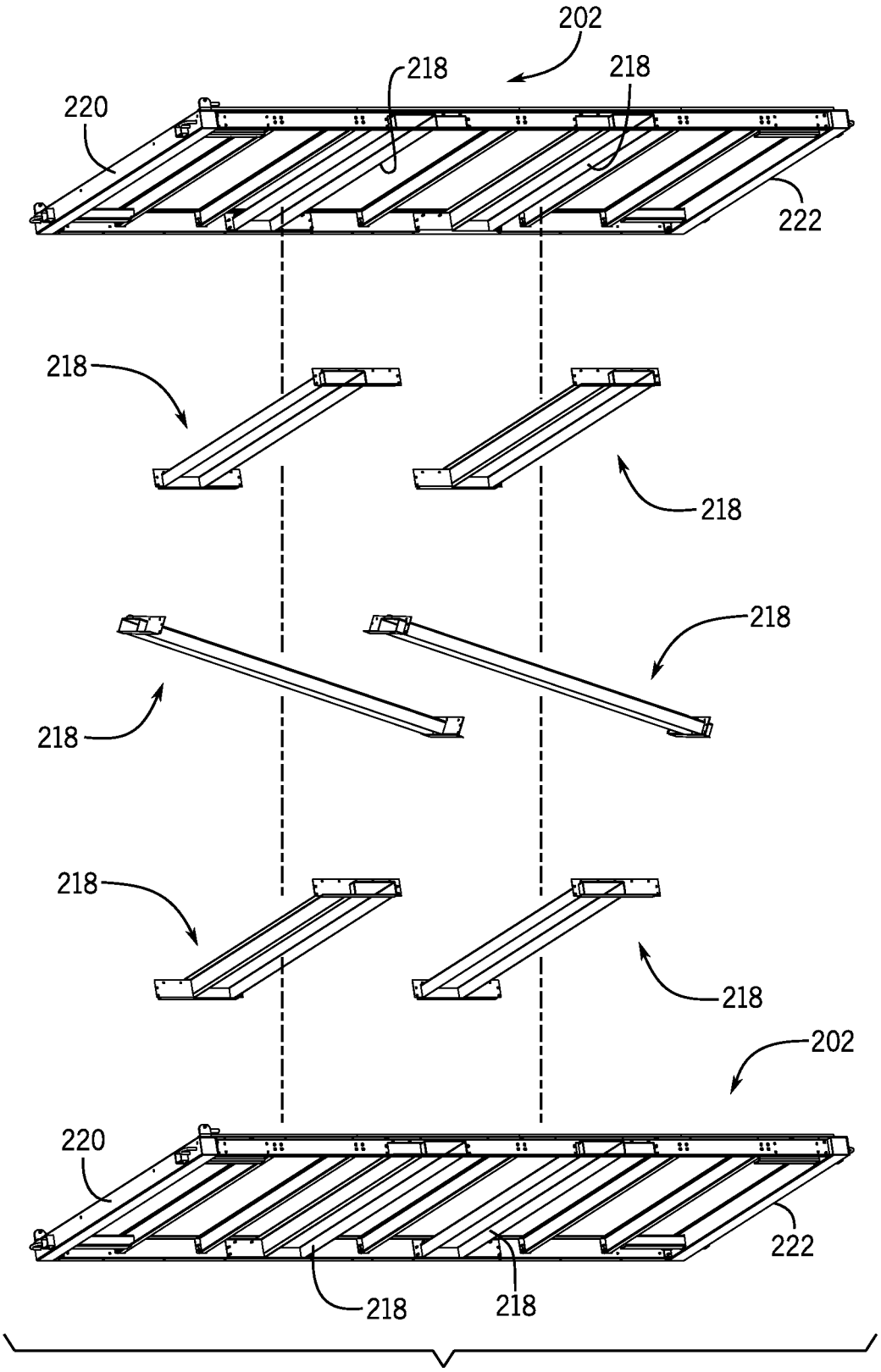
FIG. 28 is a schematic illustration of the pair of fork tunnel assemblies arranged in the base FIG. 22 switching between the first configuration and the second configuration of FIGS. 26A-27B.

As shown in FIGS. 26A and 27A, the fork tunnel assemblies 218 are installed in a first configuration where a first fork pocket distance $D_1$ is defined between centerpoints of the fork tunnels 254. In another interpretation, the first fork pocket distance $D_1$ may be defined as the sum of a distance between the centerpoint of each respective fork tunnel 254 and the central axis C. If desired, an end user may alter the fork pocket distance from the first fork pocket distance $D_1$ to a second fork pocket distance $D_2$ by moving the pair of fork tunnel assemblies 218 to a second configuration, as shown in FIGS. 26B and 27B. The first fork pocket distance $D_1$ is larger than the second fork pocket distance $D_2$. In order to switch between the first configuration and the second configuration, the fork tunnel assemblies 218 are detached from the base frame 213, rotated 180 degrees, and re-coupled to the base frame 213. FIG. 28 illustrates the 180 degree rotation utilized to switch the pair of fork tunnel assemblies 218 between the first configuration and the second configuration. Due to the design of the pair of fork tunnel assemblies 218, a 180 degree rotation of the pair of fork tunnel assemblies 218 enables the fork pocket distance defined between the fork tunnels 254 to be configurable between the first fork pocket distance $D_1$ and the second fork pocket distance $D_2$. With the pair of fork tunnel assemblies 218 being removably coupled to the base frame 213, an end user can configure the fork pocket distance in the field, if necessary. In addition, the symmetry defined by the pair of fork tunnel assembles 218 reduces the number of components in the base 202, while providing an end user with added functionality due to the configurable nature of the pair of fork tunnel assemblies 218.

FIGS. 29-32 illustrate the roof 212 of the modular shipping container 200. The roof 212 includes a roof sheet 280 and a pair of skid plate assemblies 282. The roof 212 defines a generally rectangular shape with a first end 284 and a second end 286 defining a generally shorter length than a first side 288 and a second side 290. The roof sheet 280 is a unitary piece of material that is skinned over an entirety of the roof 212. In this manner, the roof sheet 280 may reduce or eliminate seams formed thereon and thereby may reduce the chance of a leak in the roof 212. Current roof designs on shipping containers typically include multiple pieces of material bonded together, which forms multiple seams in the roof that may provide a leak path. Fabricating the roof sheet 280 from a unitary piece of material, which is skinned over the entirety of the roof 212, overcomes this deficiency in current shipping container designs. The roof sheet 280 is fabricated from a thin sheet of metal material (e.g., aluminum).

The pair of skid plate assemblies 282 are attached to a periphery of the roof sheet 280 with one of the pair of skid plate assemblies 282 arranged along the first side 288 and the other of the pair of skid plate assemblies 282 arranged along the second side 290. Each of the pair of skid plate assemblies 282 includes a first skid end cap 292, a second skid end cap 294, and a skid plate 298. Each of the first skid end caps 292 engages and partially covers the first end 284 of the roof 212, and each of the second skid end caps 294 engages and partially covers the second end 286 of the roof 212. Each of the skid plates 298 engages and covers the respective one of the first side 288 and the second side 290 along which the skid plate assembly 282 is arranged. Each of the skid plates 298 extends over their respective side 288 and 290 and along a top surface 300 of the roof sheet 280. Each of the skid plates 298 extends partially over the top surface 300 of the roof sheet 280. That is, each of the skid plates 298 extends over the top surface 300 of the roof sheet 280 an extension distance E. The extension distance E also defines how far each of the first skid end caps 292 and the second skid end caps 294 extend along the first end 284 and the second end 286, respectively.

The extension distance E is defined to ensure that the skid plates 298 are attached to the roof sheet 280 outside of an envelope defined by the modular shipping container 200. With the skid plates 298 arranged outside of the envelope of the modular shipping container 200, there may be no direct leak paths that form outside to inside the modular shipping container 200. The skid plate assemblies 282 are manufactured from a metal material with a higher hardness (e.g., stainless steel, steel, aluminum, composite materials, sandwiched composite materials, glass fiber reinforced polymers, carbon fiber reinforced polymers, carbon fiber, or steel strength plastics), when compared to the roof sheet 280. The skid plate assemblies 282 structurally reinforce the roof 212 and the skid plates 298 provide locations for other containers to be stacked on top of the roof 212. Additionally, the skid plate assemblies 282 may aid in preventing the roof sheet 280 from being punctured by other containers stacked upon or next to the roof 212.

Figure 30:
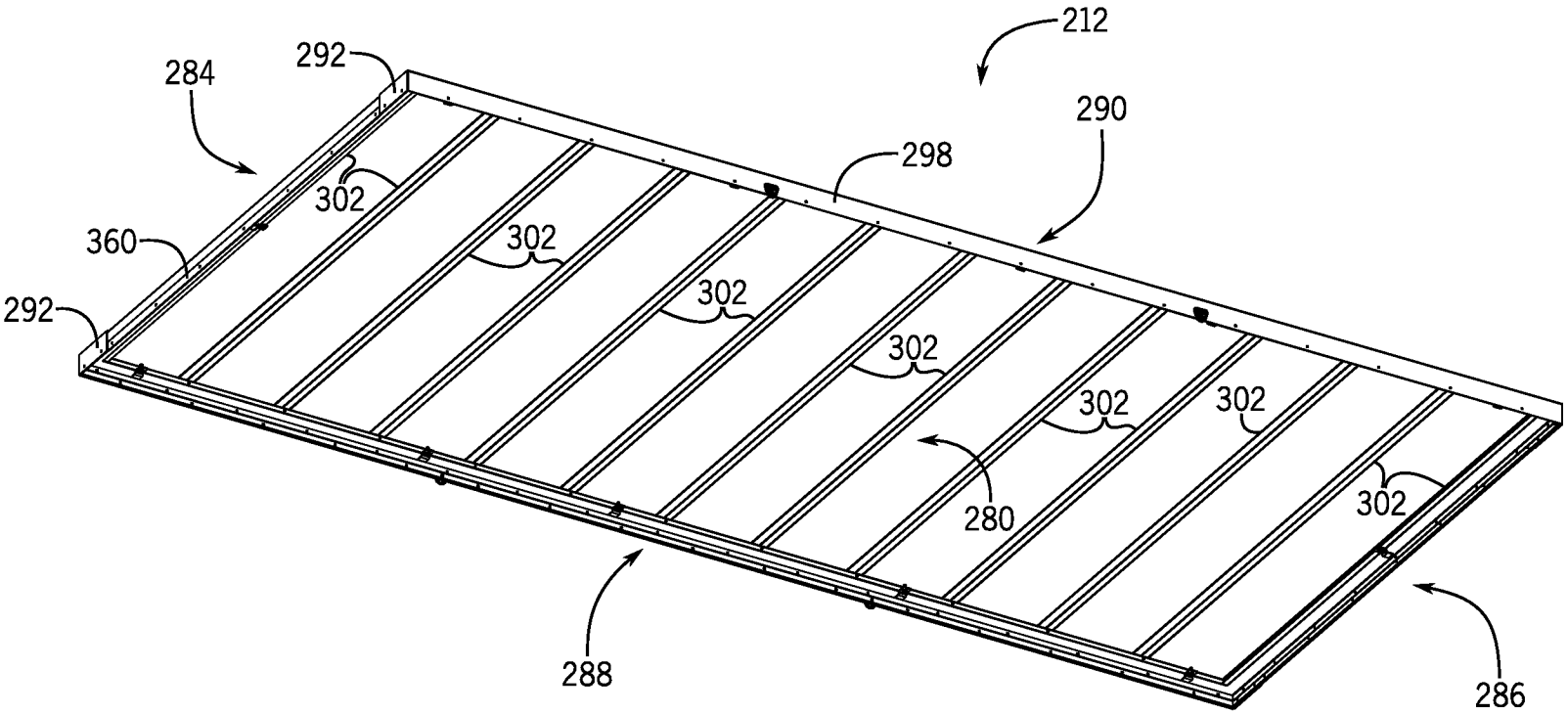
FIG. 30 is a bottom, front, left isometric view of the roof of the modular shipping container of FIG. 20.
Figure 31:
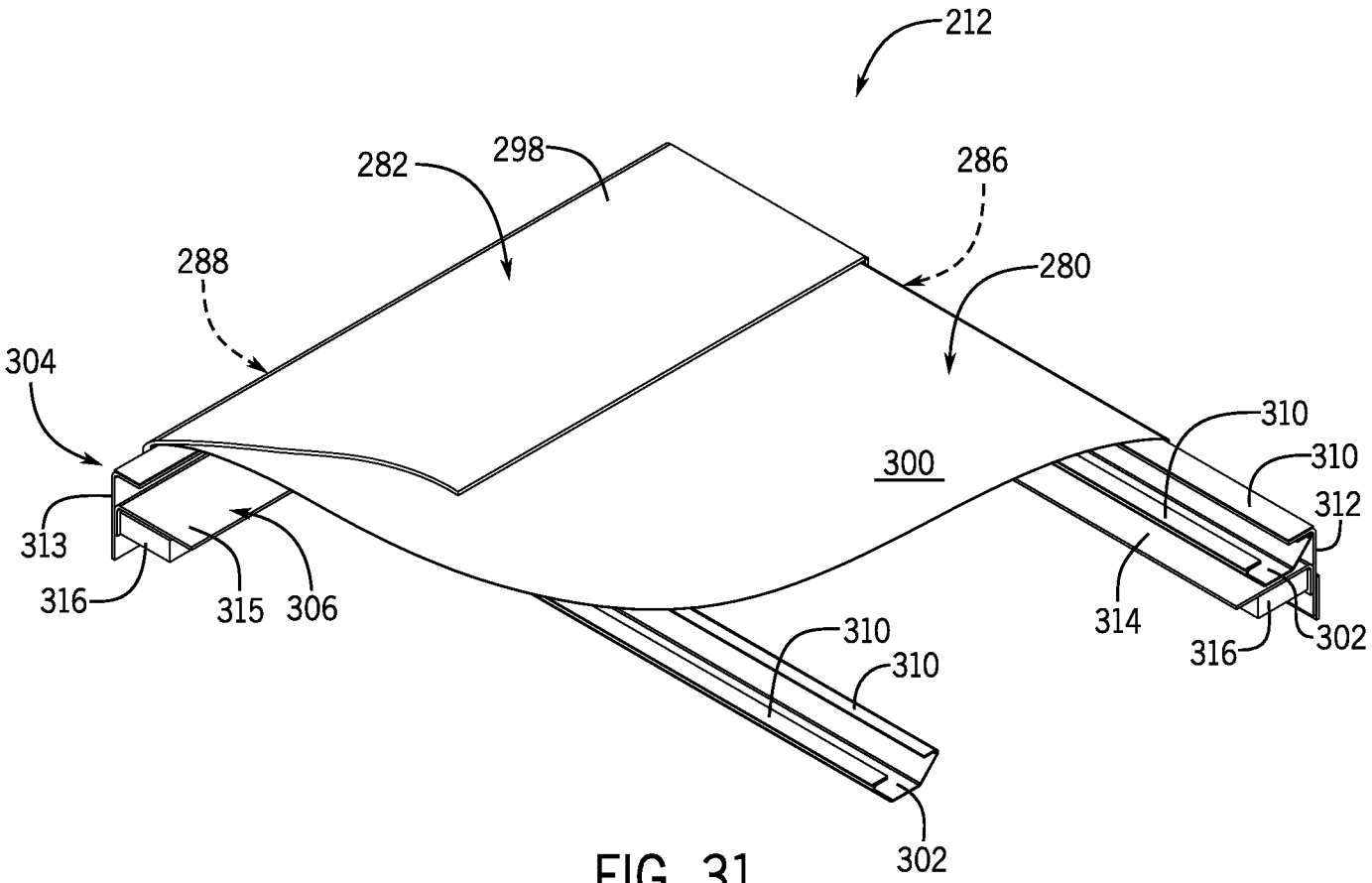
FIG. 31 is magnified view of a portion of the roof of FIG. 29.
Figure 32:
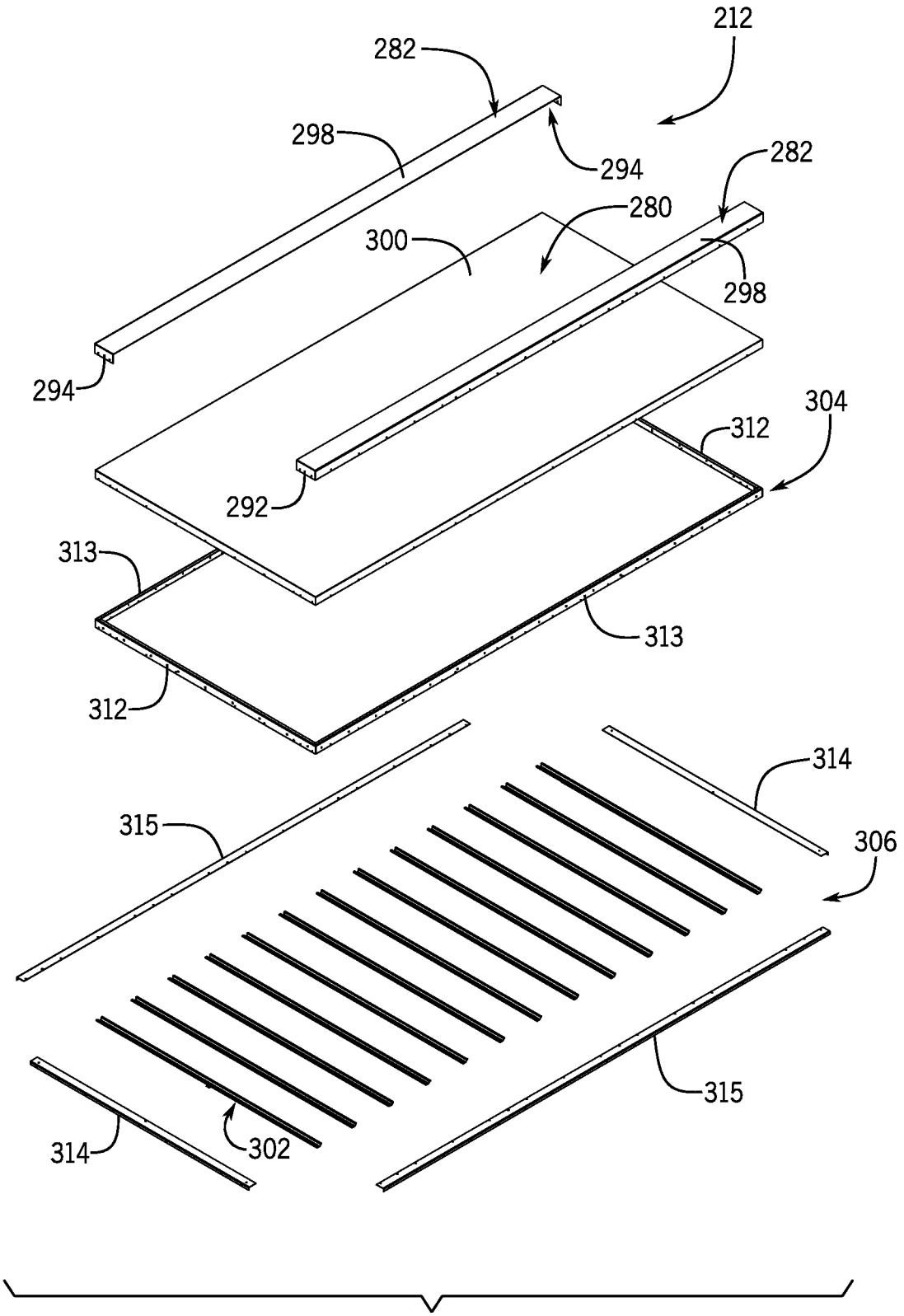
FIG. 32 is an exploded top, front, left isometric view of the roof of the modular shipping container of FIG. 20.

Referring to FIGS. 30-32, the roof 212 includes a plurality of roof bows 302 that extend between the first side 288 and the second side 290 and are spaced longitudinally under the roof sheet 280. The plurality of roof bows 302 are secured under the roof sheet 280 at least partially between an outer angle assembly 304 and an inner angle assembly 306. The plurality of roof bows 302 may be attached to a bottom surface 308 of the roof sheet 280 via an adhesive tape attached to one or more bow flanges 310 arranged on each of the plurality of roof bows 302.

The illustrated outer angle assembly 304 extends around an inner periphery of the roof sheet 280 and is formed by a plurality of segmented outer angle supports. That is, a pair of outer end angle supports 312 are dimensioned to be arranged under the roof sheet 280 along each of the first end 284 and the second end 286, and a pair of outer side angle supports 313 are dimensioned to be arranged under the roof sheet 280 along each of the first side 288 and the second side 290. Similarly, the illustrated inner angle assembly 306 extends around an inner periphery of the roof sheet 280, within the outer angle assembly 304, and is formed by a plurality of segmented inner angle supports. That is, a pair of inner end angle supports 314 are dimensioned to be arranged under the roof sheet 280 along each of the first end 284 and the second end 286, and a pair of inner side angle supports 315 are dimensioned to be arranged under the roof sheet 280 along each of the first side 288 and the second side 290. In other embodiments, for example, the outer angle assembly 304 and/or the inner angle assembly 306 may not be segmented but formed as a unitary support.

A gasket 316 is arranged under the inner angle assembly 306 and is configured to provide a seal between an upper end of each of the first end wall 204, the second end wall 206, the first side wall 208, and the second side wall 210 and the roof 212, as will be described. The gasket 316 may be fabricated from segmented portions, or may be fabricated from as a unitary component. The gasket 316 may be fabricated from a rubber material (e.g., ethylene propylene diene monomer).

Figure 29:
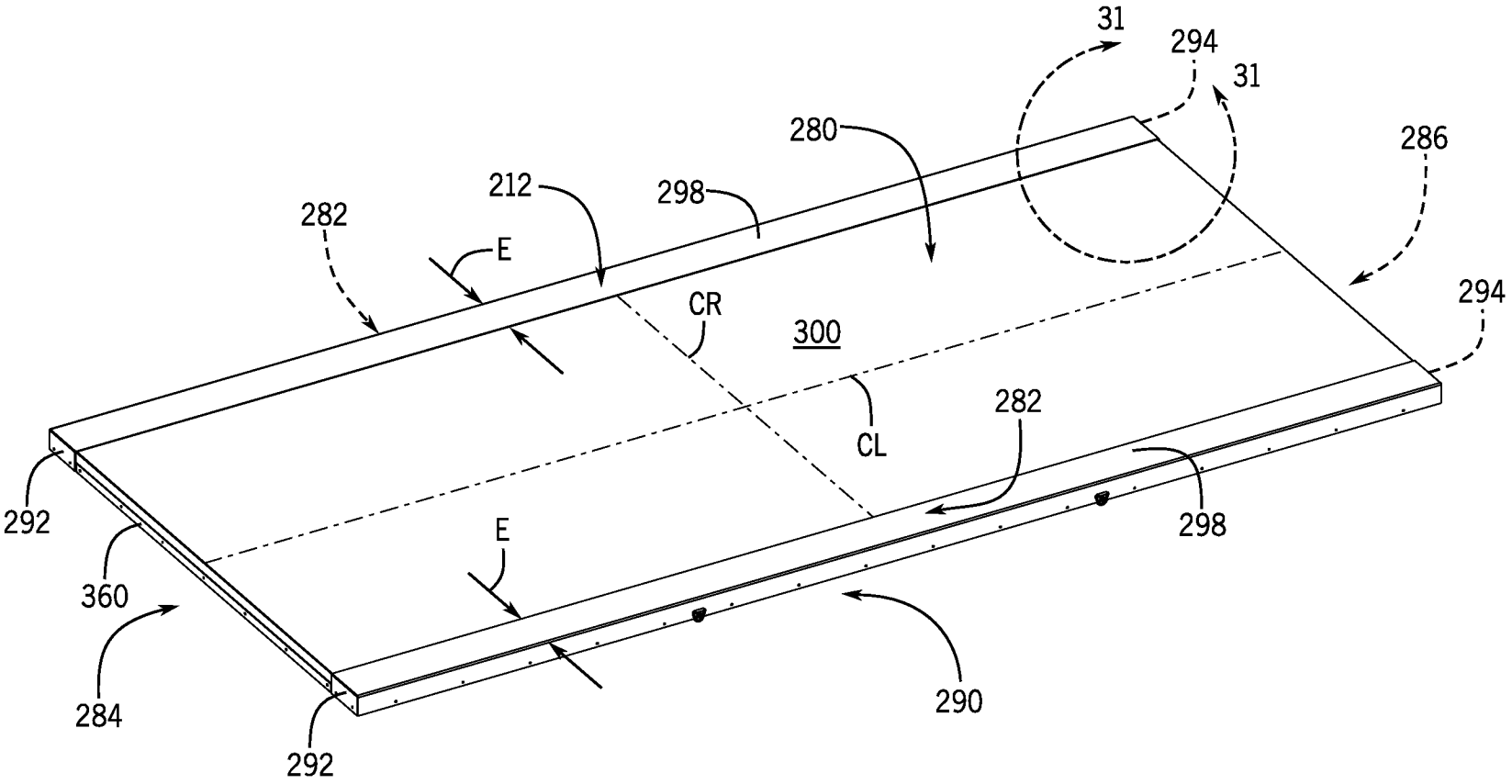
FIG. 29 is a top, front, left isometric view of a roof of the modular shipping container of FIG. 20.
Figure 33:
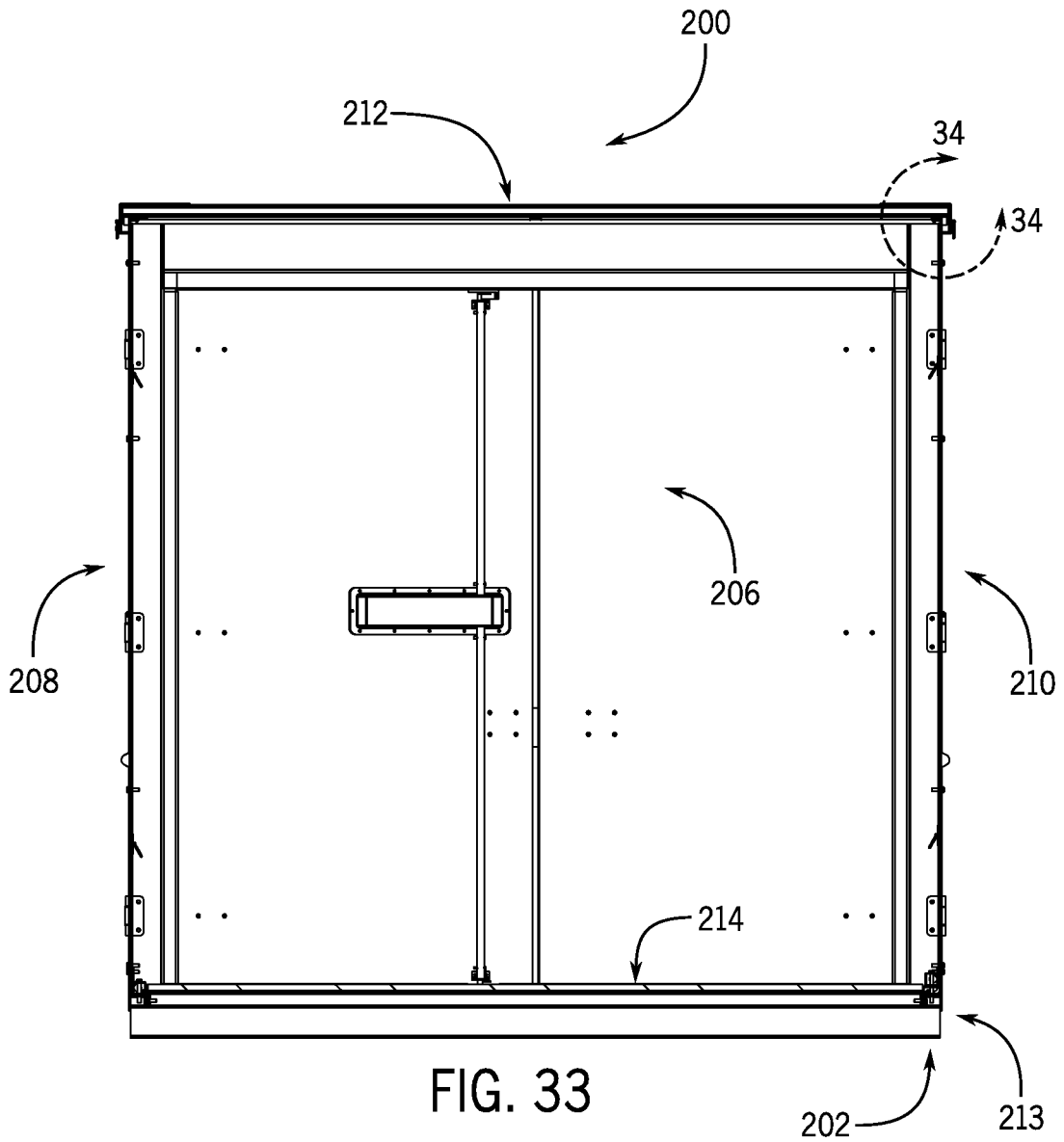
FIG. 33 is a cross-sectional view of the modular shipping container of FIG. 20 taken generally along the line 33-33 of FIG. 20.
Figure 34:
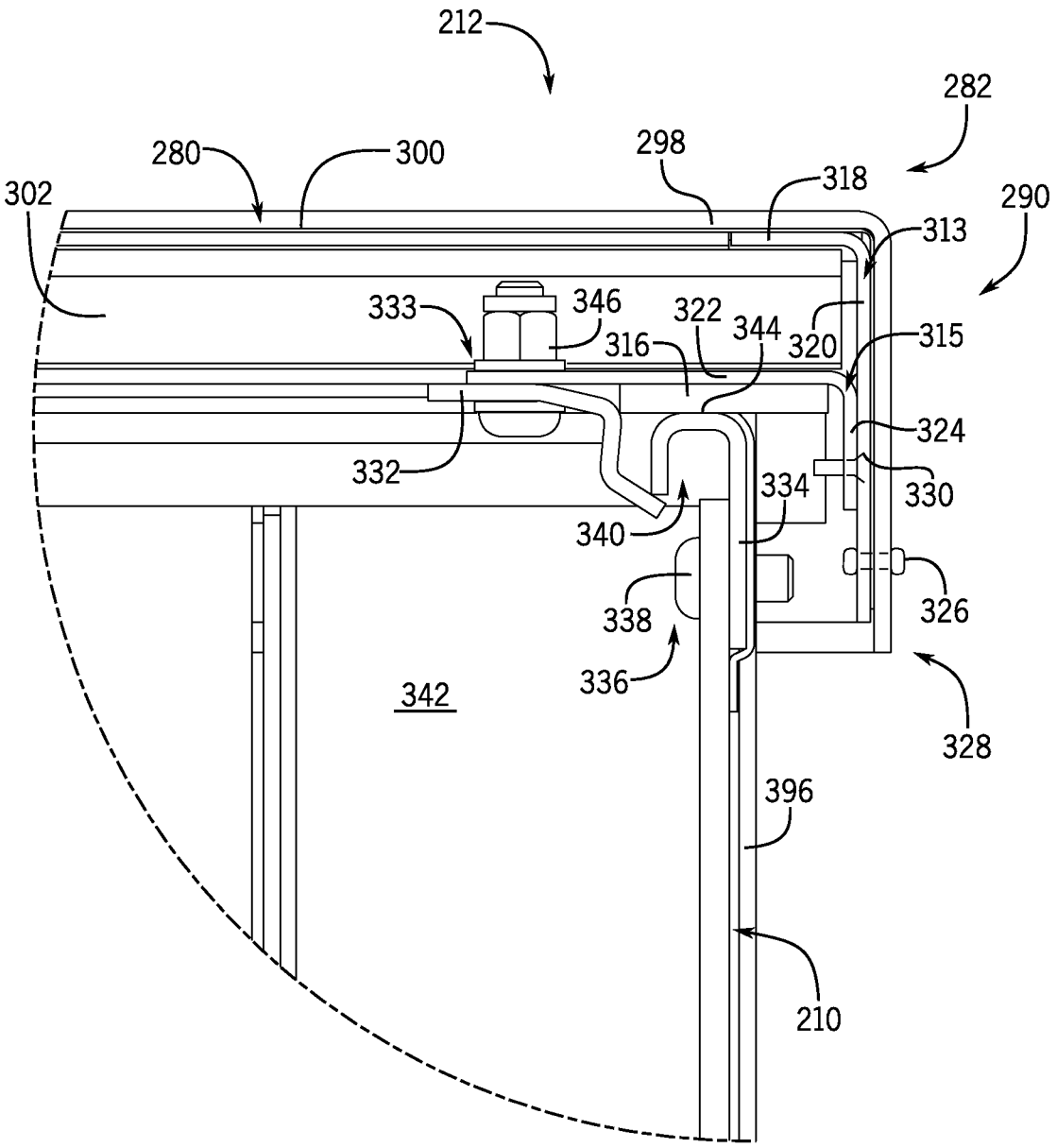
FIG. 34 is a magnified view of a portion of the modular shipping container of FIG. 33.

It should be appreciated that the roof 212 is symmetric about a central longitudinal axis CL (see FIG. 29). Therefore, the following description of the configuration of the roof 212 and the upper end 336 of the second side wall 210 symmetrically applies to the roof 212 and the upper end of the first side wall 208. As such, similar components are identified using like reference numerals in the figures. Turning to FIGS. 33 and 34, the outer side angle support 313 defines a generally L-shaped profiled and includes an outer top portion 318 and an outer side portion 320. The outer top portion 318 is arranged generally parallel to the top surface 300 of the roof sheet 280. The outer side portion 320 extends down along the second side 290 of the roof 212 and is arranged substantially perpendicularly to the top surface 300 of the roof sheet 280. The inner side angle support 315 defines a generally L-shaped profile and includes an inner top portion 322 and an inner side portion 324. The inner top portion 322 is arranged generally parallel to the top surface 300 of the roof sheet 280. The inner side portion 324 extends downward from the inner top portion 322 and is arranged substantially perpendicularly to the top surface 300 of the roof sheet 280.

The roof sheet 280 extends under the skid plate assembly 282 and over the outer top portion 318 and the outer side portion 320 of the outer side angle support 313. The outer side portion 320 extends down along the second side 290 of the roof 212 further than the inner side portion 324. A fastening element 326 extends through the skid plate 298, the roof sheet 280, and the outer side portion 320 at a location adjacent to a bottom end 328 of the second side 290 of the roof 212. The illustrated fastening element 326 is in the form of a rivet; however, other types of fastening mechanisms may be implemented. A plurality of the fastening elements 326 are arranged longitudinally along the bottom end 328 of the second side 290 to fasten the roof sheet 280 to the second side 290 of the roof 212.

The inner side portion 324 of the inner side angle support 315 engages the outer side portion 320 of the outer side angle support 313 on a side opposite of the roof sheet 280 and at a location between the fastening elements 326 and the outer top portion 318. The inner side portion 324 of the inner side angle support 315 is fastened to the outer side portion 320 of the outer side angle support 313 by a fastening element 330. The illustrated fastening element 330 is in the form of a countersunk rivet; however, other types of fastening mechanisms may be implemented. The fastening element 330 is countersunk into the outer side portion 320 and extends through the inner side portion 324. A plurality of the fastening elements 330 are arranged longitudinally along the second side 290 to fasten the outer side angle support 313 to the inner side angle support 315.

An end of the each roof bow 302 is secured between the outer top portion 318 and the inner top portion 322. The end of each roof bow 302 is fastened to a distal end 333 of the inner top portion 322 of the inner side angle support 315 via a fastening element 331 (best illustrated in FIG. 35). One of the fastening elements 331 fastens each end of each roof bow 302 to one of the pair of inner side angle supports 315. The fastening elements 331 are in the form of rivets; however, other fastening mechanisms may be implemented.

Figure 35:
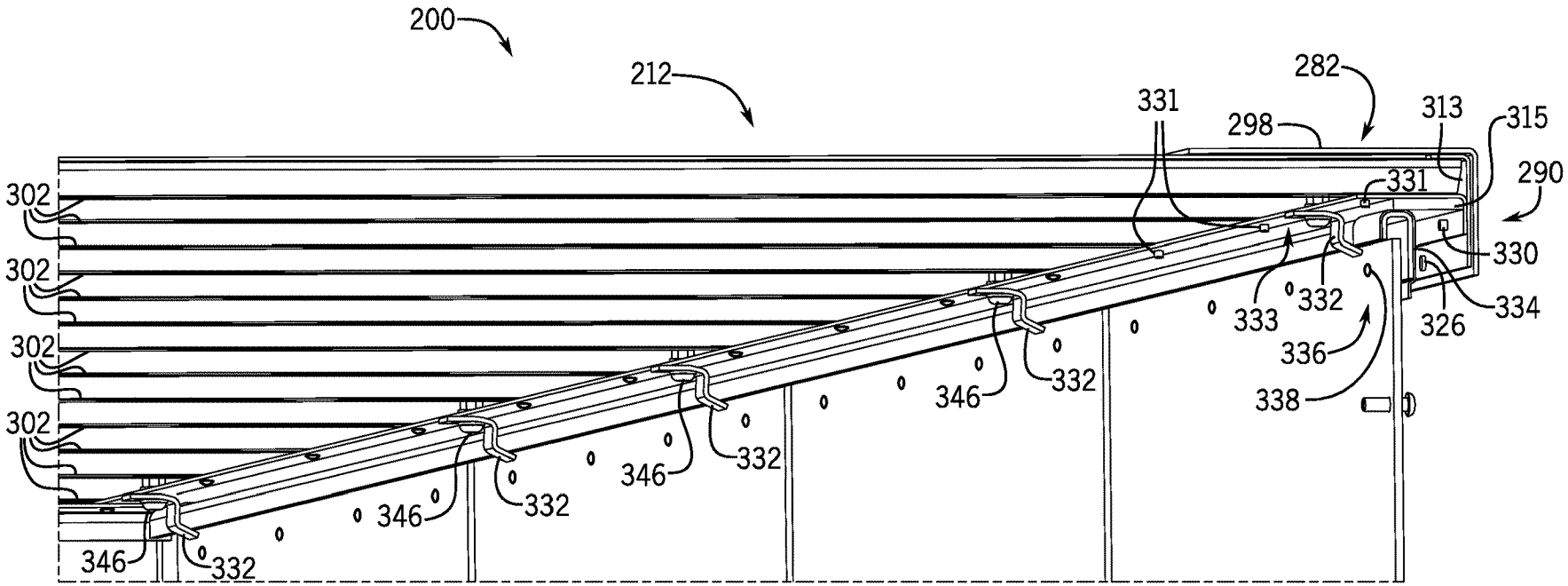
FIG. 35 is a bottom, back, left isometric view of a portion of the modular shipping container of FIG. 33.

With continued reference to FIGS. 33 and 34, the inner top portion 322 extends inward, away from the second side 290, a further distance than the outer top portion 318. The gasket 316 is attached to the inner top portion 322 opposite the roof bow 302. The gasket 316 extends longitudinally along the entirety of the inner top portion 322 of the inner side angle support 315 (as best shown in FIG. 35). A distal end 333 of the inner top portion 322 is in engagement with and removably coupled to an side wall bracket 332. The side wall bracket 332 is configured to engage a side wall extension 334. The side wall extension 334 extends longitudinally along the entire upper end 336 of the second side wall 210. The side wall extension 334 is coupled to the upper end 336 of the second side wall 210 by a fastening element 338. The illustrated fastening element 338 is in the form of a rivet; however, other types of fastening mechanisms may be implemented. A plurality of the fastening elements 338 extend along the upper end 336 of the second side wall 210 to fasten the side wall extension 334 to the upper end 336 of the second side wall 210.

The side wall extension 334 extends from the upper end 336 of the second side wall 210 toward the gasket 316 and includes a generally hook, or U-shaped, portion 340. The hook portion 340 extends past the upper end 336 of the second side wall 210 and hooks inward toward an internal cavity 342 defined within the modular shipping container 200, when assembled. The hook portion 340 includes a seal surface 344 that is arranged generally parallel to the inner top portion 322 of the inner side angle support 315. The seal surface 344 engages the gasket 316 to form a seal between therebetween. As described above, the roof sheet 280 is fabricated as a unitary component, which may eliminate any seams formed thereon and thereby may reduce the chance of a leak in the roof 212. The combination of the roof sheet 280 and the seal formed between the side wall extension 334 and the gasket 316 of the roof 212 aid in isolating the internal cavity 342 of the modular shipping container 200 from the outside. This helps reduce or prevent leak paths from forming through the roof 212, or at the junction between the roof 212 and the second side wall 210. In addition, the roof sheet 280, the skid plate 298, and the outer side portion 320 extend below the seal formed between the gasket 316 and the side wall extension 334, which help shield the seal, for example, from rain fall.

The distal end 333 of the inner top portion 322 of the inner side angle support 315 is removably coupled to the side wall bracket 332 by a fastening element 346. The illustrated fastening element 346 is in the form of a bolt and nut; however, other removable coupling mechanisms may be implemented. The side wall bracket 332 is configured to engage the hook portion 340 of the side wall extension 334. In this way, as the fastening element 346 is tightened, the gasket 316 is compressed between the seal surface 344 of the side wall extension 334 and the inner top portion 322 of the inner side angle support.

A plurality of the side wall brackets 332 may be arranged along the side wall extension 334 to removably couple the second side wall 210 to the roof 212. As shown in FIG. 35, the illustrated side wall extension 334 includes five side wall brackets 332 spaced longitudinally along the side wall extension 334. In other embodiments, for example, the side wall extension 334 may include more or less than five side wall brackets 332. The side wall brackets 332 are removably coupled to the inner side angle support 315 to enable the roof 212 to be attached and detached from the second side wall 210, as desired. That is, during assembly of the modular shipping container 200, once each of the first end wall 204, the second end wall 206, the first side wall 208, and the second side wall 210 are erected, the roof 212 can be placed over the upper end 336 of the second side wall 210 such that the gasket 316 engages the seal surface 344. The seal surface 344 may partially compress the gasket 316 between the inner side angle support 315 and the seal surface 344 to form the seal therebetween, and the side wall brackets 332 may be coupled to the inner side angle support 315 to secure the second side wall 210 to the roof 212. The side wall brackets 332 may be un-coupled from the inner side angle support 315 to enable the modular shipping container 200 to be disassembled, as will be described below.

Figure 36:
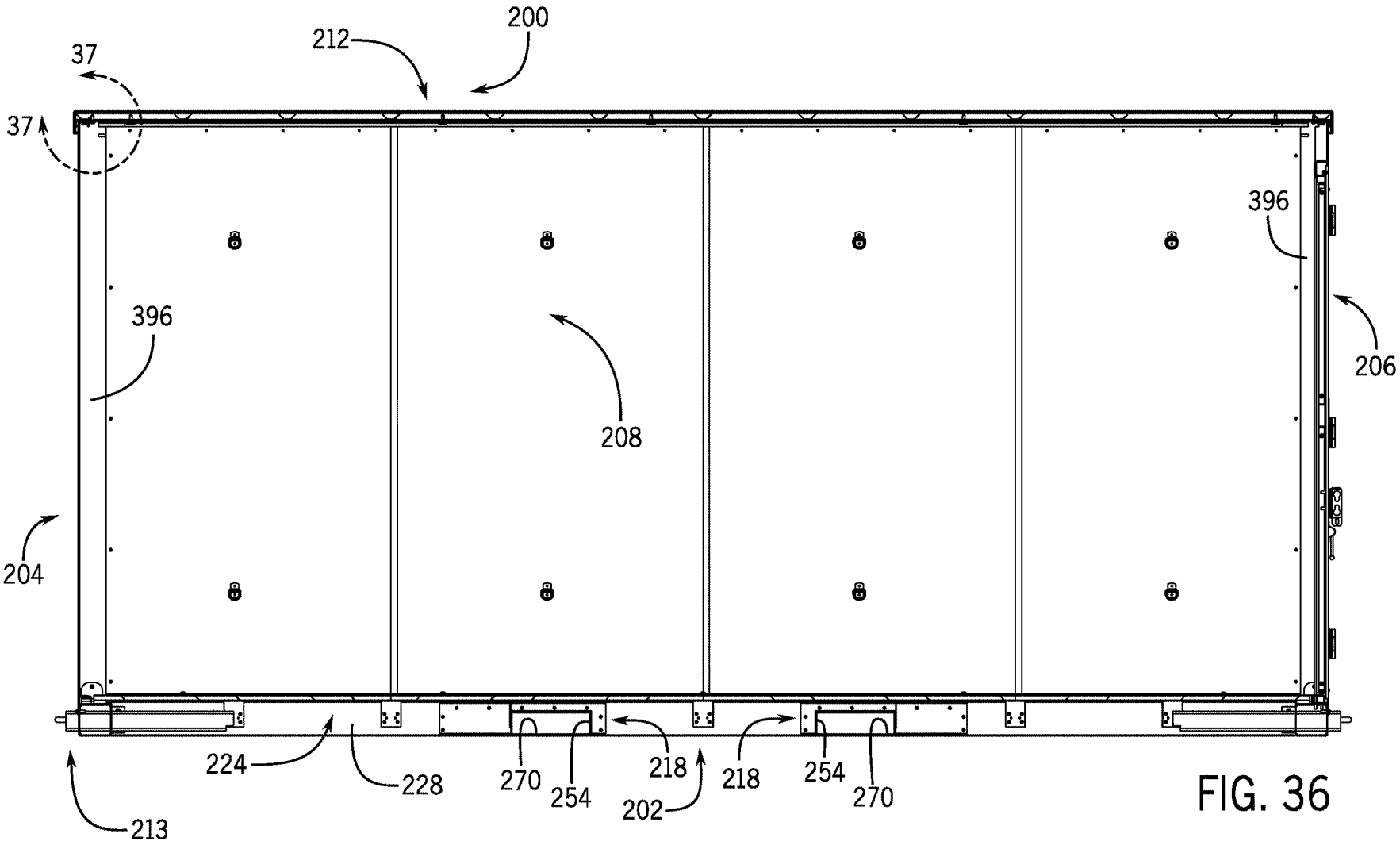
FIG. 36 is a cross-sectional view of the modular shipping container of FIG. 20 taken generally along the line 36-36 of FIG. 20.
Figure 37:
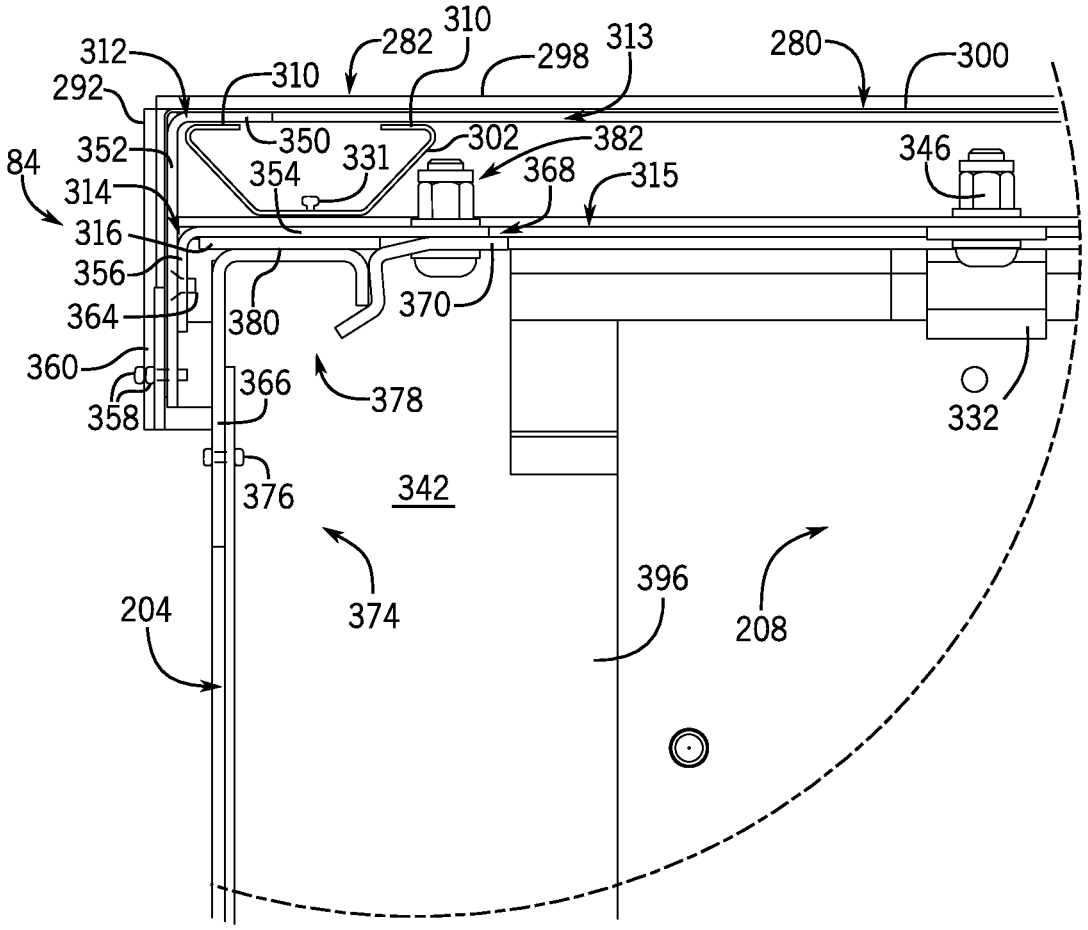
FIG. 37 is a magnified view of a portion of the modular shipping container of FIG. 36.

It should be appreciated that the roof 212 is symmetric about a central axis CR arranged perpendicular to the central longitudinal axis CL. Therefore, the following description of the configuration of the roof 212 and the upper end 374 of the first end wall 204 symmetrically applies to the roof 212 and the upper end of the second end wall 206. As such, similar components are identified using like reference numerals in the figures. Turning to FIGS. 36 and 37, the outer end angle support 312 defines a generally L-shaped profiled and includes an outer end top portion 350 and an outer end side portion 352. The outer end top portion 350 is arranged generally parallel to the top surface 300 of the roof sheet 280. The outer end side portion 352 extends down along the first end 284 of the roof 212 and is arranged substantially perpendicularly to the top surface 300 of the roof sheet 280. The inner end angle support 314 defines a generally L-shaped profile and includes an inner end top portion 354 and an inner end side portion 356. The inner end top portion 354 is arranged generally parallel to the top surface 300 of the roof sheet 280. The inner end side portion 356 extends downward from the inner end top portion 354 and is arranged substantially perpendicularly to the top surface 300 of the roof sheet 280.

The roof sheet 280 extends over the outer end top portion 350 and the outer end side portion 352 of the outer end angle support 312. The outer end side portion 352 extends down along the first end 284 of the roof 212 further than the inner end side portion 356. A fastening element 358 extends through an attachment strip 360, the roof sheet 280, and the outer end side portion 352 at a location adjacent to a bottom end 362 of the first end 284 of the roof 212. The attachment strip 360 extends along the first end 284 of the roof 212 between the first skid end caps 292 arranged thereon. The illustrated fastening element 358 is in the form of a rivet; however, other types of fastening mechanisms may be implemented. A plurality of the fastening elements 358 are arranged longitudinally along attachment strip 360 and the first skid end caps 292 to fasten the roof sheet 280 to the first end 284 of the roof 212.

The inner end side portion 356 of the inner end angle support 314 engages the outer end side portion 352 of the outer end angle support 312 on a side opposite of the roof sheet 280 and at a location between the fastening elements 358 and the outer end top portion 350. The inner end side portion 356 of the inner end angle support 314 is fastened to the outer end side portion 352 of the outer end angle support 312 by a fastening element 364. The illustrated fastening element 364 is in the form of a countersunk rivet; however, other types of fastening mechanisms may be implemented. The fastening element 364 is countersunk into the outer end side portion 352 and extends through the inner end side portion 356. A plurality of the fastening elements 364 are arranged along the first end 284 to fasten the outer end angle support 312 to the inner side angle support 314.

The outer end top portion 350 extends partially over the illustrated one of the plurality of roof bows 302 arranged adjacent to the first end 284. Specifically, the outer end top portion 350 extends over one of the bow flanges 310 arranged adjacent to the first end 284 of the roof 212.

With continued reference to FIGS. 36 and 37, the inner end top portion 354 extends inward, away from the first end 284, a distance farther than the outer end top portion 350. The gasket 316 is attached to the inner end top portion 354 opposite the roof bow 302. The gasket 316 extends longitudinally along the entirety of the inner end top portion 354 of the inner end angle support 314. A distal end 368 of the inner end top portion 354 is in engagement with and removably coupled to an end wall bracket 370. The end wall bracket 370 is configured to engage an end wall extension 366. The end wall extension 366 extends along the entire upper end 374 of the first end wall 204. The end wall extension 366 is coupled to the upper end 374 of the first end wall 204 by a fastening element 376. The illustrated fastening element 376 is in the form of a rivet; however, other types of fastening mechanisms may be implemented. A plurality of the fastening elements 376 are arranged along the upper end 374 of the first end wall 204 to fasten the end wall extension 366 to the upper end 374 of the first end wall 204.

The end wall extension 366 extends from the upper end 374 of the first end wall 204 toward the gasket 316 and includes a generally hook, or U-shaped, portion 378. The hook portion 378 extends past the upper end 374 of the first end wall 204 and hooks inward toward the internal cavity 342. The hook portion 378 includes a seal surface 380 that is arranged generally parallel to the inner end top portion 354 of the inner end angle support 314. The seal surface 380 engages the gasket 316 to form a seal between therebetween. As described above, the roof sheet 280 is fabricated as a unitary component, which may reduce or eliminate seams formed thereon and thereby may reduce the chance of a leak in the roof 212. The combination of the roof sheet 280 and the seal formed between the end wall extension 366 and the gasket 316 of the roof 212 aid in isolating the internal cavity 342 of the modular shipping container 200 from the outside. This may reduce or prevent leak paths from forming through the roof 212, or at the junction between the roof 212 and the first end wall 204. In addition, the roof sheet 280, the attachment strip 360, and the outer end side portion 352 extend below the seal formed between the gasket 316 and the end wall extension 366, which help shield the seal, for example, from rain fall.

The distal end 368 of the inner end top portion 354 of the inner end angle support 314 is removably coupled to the end wall bracket 370 by a fastening element 382. The illustrated fastening element 382 is in the form of a bolt and nut; however, other removable coupling mechanisms may be implemented. The end wall bracket 370 is configured to engage the hook portion 378 of the end wall extension 366. In this way, as the fastening element 382 is tightened, the gasket 316 is compressed between the seal surface 380 of the end wall extension 366 and the inner end top portion 354 of the inner end angle support 314.

Figure 38:
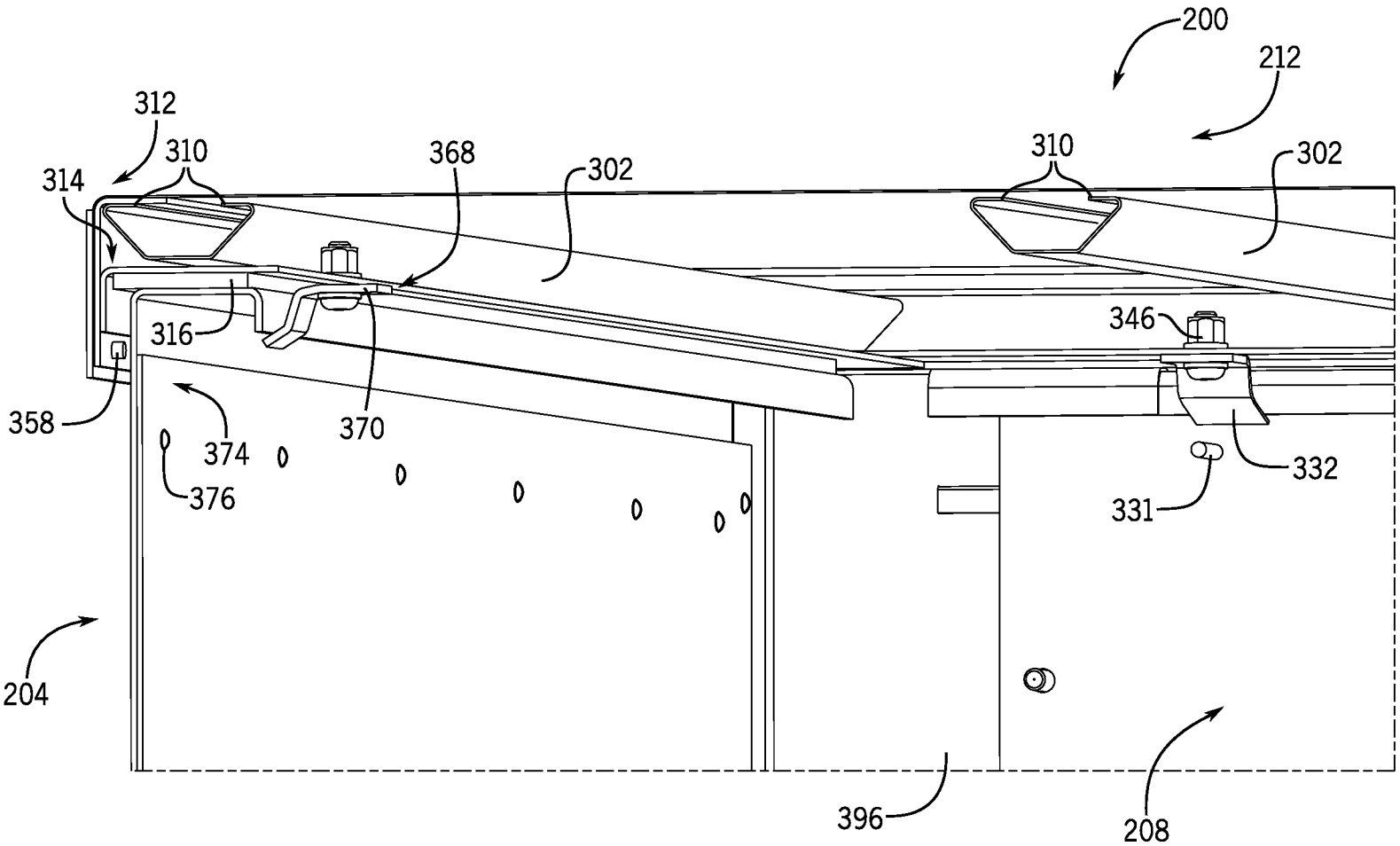
FIG. 38 is a bottom, front, right isometric view of a portion of the modular shipping container of FIG. 36.

As shown in FIG. 38, the illustrated end wall extension 366 includes one end wall bracket 370 generally centered along the upper end 374 of the first end wall 204. In other embodiments, for example, the end wall extension 366 may include more or less than one end wall bracket 370. The end wall bracket 370 is removably coupled to the inner end angle support 314 to enable the roof 212 to be attached and detached from the first end wall 204, as desired. That is, during assembly of the modular shipping container 200, once each of the first end wall 204, the second end wall 206, the first side wall 208, and the second side wall 210 are erected, the roof 212 can be placed over the upper end 374 of the first end wall 204 such that the gasket 316 engages the seal surface 380. The seal surface 380 may partially compress the gasket 316 between the inner end angle support 314 and the seal surface 380 to form the seal therebetween, and the end wall bracket 370 may be coupled to the inner end angle support 314 to secure the first end wall 204 to the roof 212. The end wall bracket 370 may be un-coupled from the inner end angle support 314 to enable the modular shipping container 200 to be disassembled, as will be described below.

The design and configuration of the above-described roof 212 for the modular shipping container 200 provides the unitary roof sheet 280 without any seams formed therein. Additionally, the roof 212 is provided with a gasket 316 configured to provide a seal between the upper ends of each of the first end wall 204, the second end wall 206, the first side wall 208 and the second side wall 210, when the modular shipping container 200 is assembled. Further, the roof 212 is removably coupled to each of the first end wall 204, the second end wall 206, the first side wall 208 and the second side wall 210 to enable assembly and disassembly of the modular shipping container 200, as desired. It should be appreciated that the above-described characteristics and properties of the roof 212 are not limited to use with the modular shipping container 200, and may be applied to any shipping container.

Figure 39:
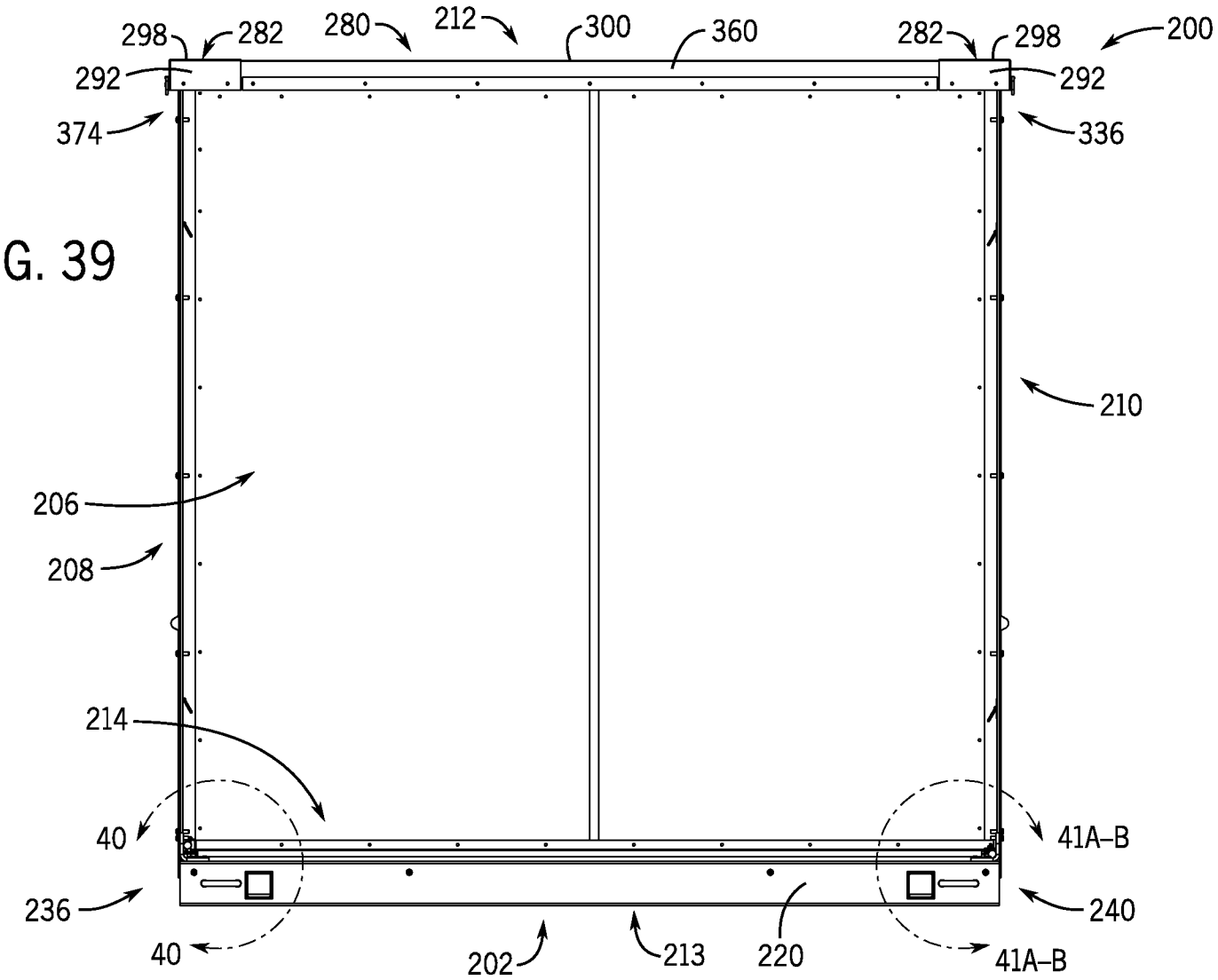
FIG. 39 is a left side view of the modular shipping container of FIG. 20 with a first end wall removed.
Figure 40:
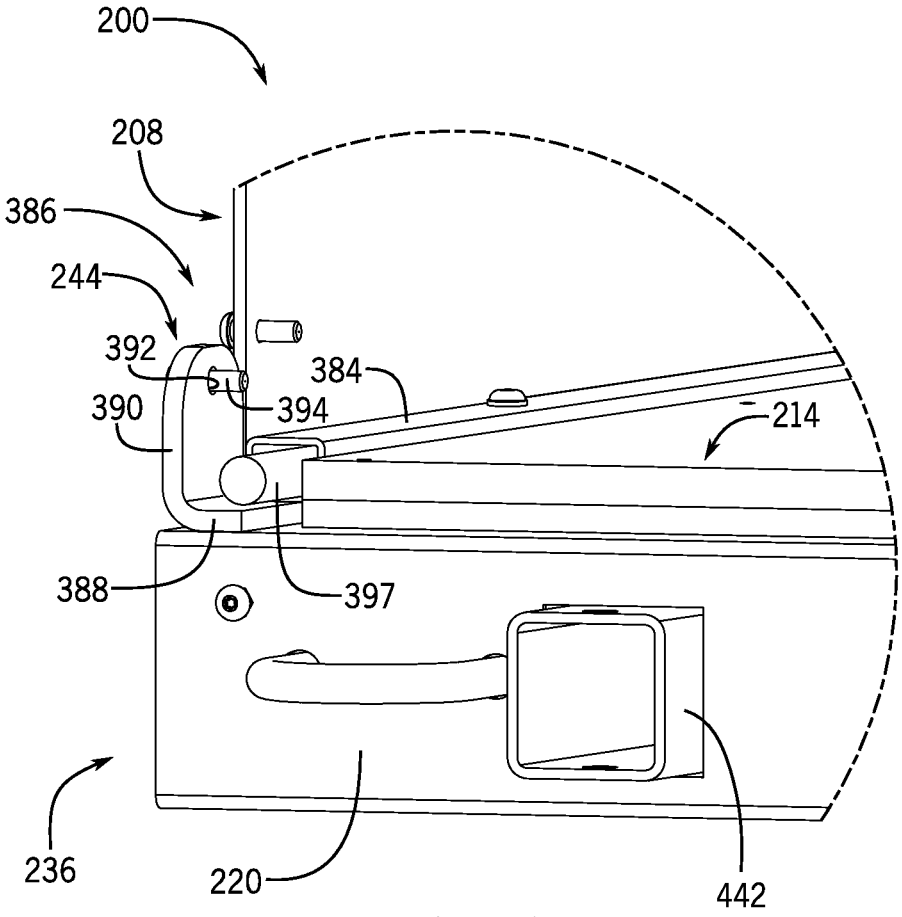
FIG. 40 is a magnified top, front, left isometric view of a portion of the modular shipping container of FIG. 39.

FIGS. 39-41 illustrate the pivotal coupling of the first side wall 208 and the second side wall 210 to the base 202 of the modular shipping container 200. As described above, the first end rail 220 includes the first stationary hinge pin assembly 244 attached to the distal end 236 and the stationary second hinge pin assembly 246 attached to the opposing distal end 240. As shown in FIG. 40, the first side wall 208 includes a first side tube hinge 384 attached to a bottom end 386 thereof. The first side tube hinge 384 extends longitudinally along the bottom end 386 of the first side wall 208, which may increase a rigidity of the first side wall 208. The first side tube hinge 384 defines a generally hollow tube with a generally rectangular profile, although other profiles may be utilized.

The first stationary hinge pin assembly 244 is configured to interact with the first side tube hinge 384 to enable a pivotal coupling between the first side wall 208 and the base 202. The first stationary hinge pin assembly 244 defines a general L-shape and includes an attachment portion 388 and a flange portion 390. The attachment portion 388 is attached to the distal end 236 of the first end rail 220 and is arranged generally parallel to the floor 214 of the base 202. The flange portion 390 extends upward substantially perpendicularly from the attachment portion 388. The flange portion 390 includes a coupling aperture 392 arranged therein. The coupling aperture 392 is configured to receive a fastening element 394 to removably couple the first stationary hinge pin assembly 244 to one of a plurality of retainer flanges 396.

A pivot pin 397 is attached to the first stationary hinge pin assembly 244 and extends therefrom. The pivot pin 397 is attached to the first stationary hinge pin assembly 244 adjacent to a junction between the attachment portion 388 and the flange portion 390. The pivot pin 397 extends from the first stationary hinge pin assembly 244 in a direction away from the first end wall 204 and is configured to be received within the first side tube hinge 384 of the first side wall 208. The arrangement of the pivot pin 397 within the first side tube hinge 384 enables the pivotal rotation of the first side wall 208 during assembly and disassembly of the modular shipping container 200, as will be described.

Figure 41A:
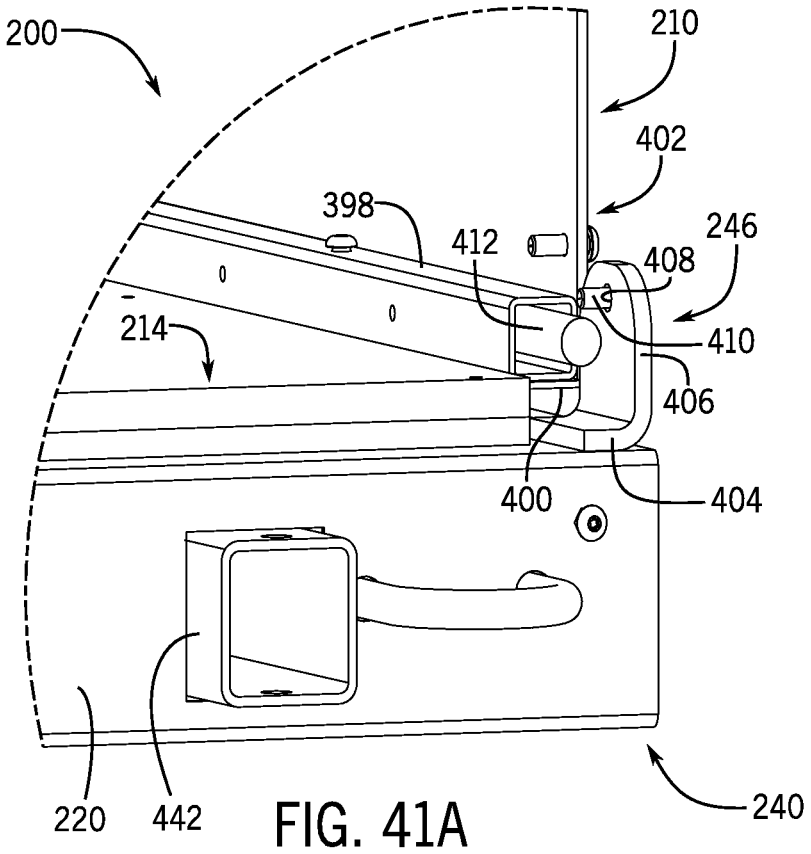
FIG. 41A is a magnified top, back, left isometric view of a portion of the modular shipping container of FIG. 39.
Figure 41B:
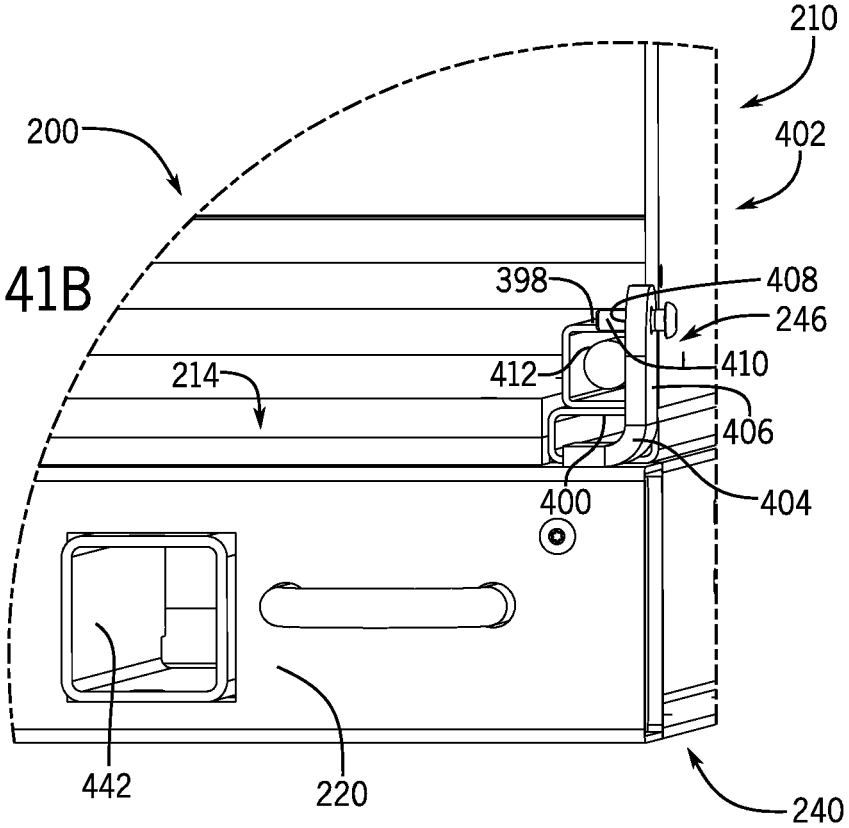
FIG. 41B is a magnified top, front, left isometric view of a portion of the modular shipping container of FIG. 39.
Figure 42:
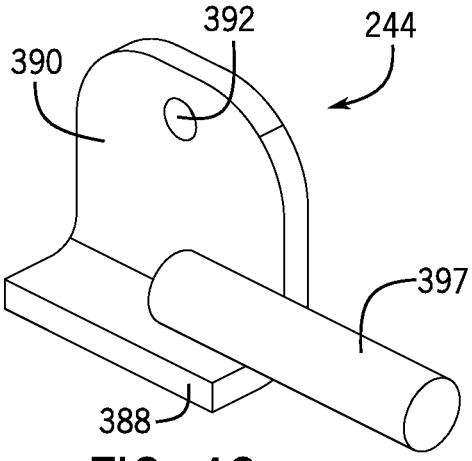
FIG. 42 is a top, front, right isometric view of a first stationary hinge pin assembly of the modular shipping container of FIG. 20.
Figure 43:
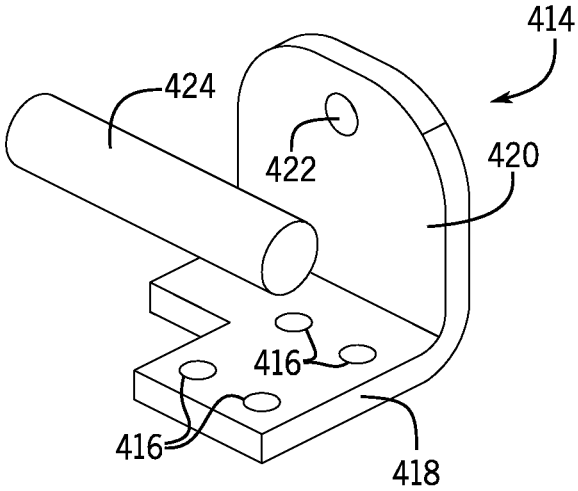
FIG. 43 is a top, front, right isometric view of a first removable hinge pin assembly of the modular shipping container of FIG. 20.
Figure 44:
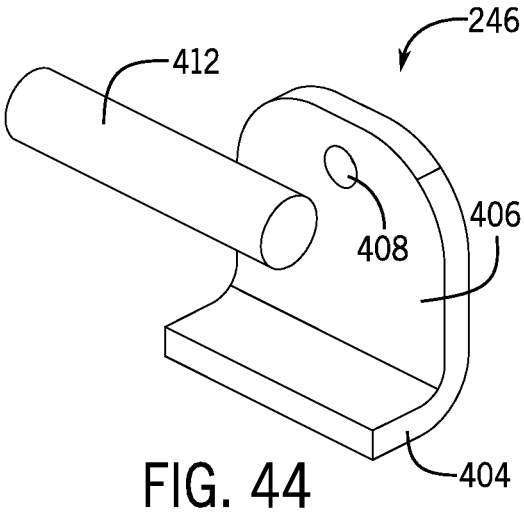
FIG. 44 is a top, back, left isometric view of a second stationary hinge pin assembly of the modular shipping container of FIG. 20.
Figure 45:
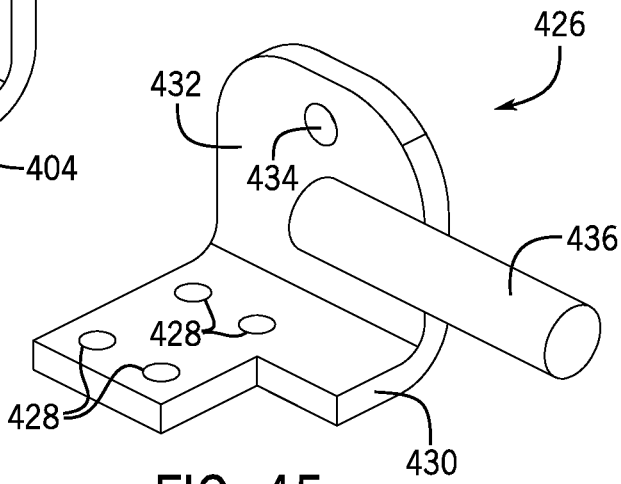
FIG. 45 is a top, back, left isometric view of a second removable hinge pin assembly of the modular shipping container of FIG. 20.
Figure 46C:
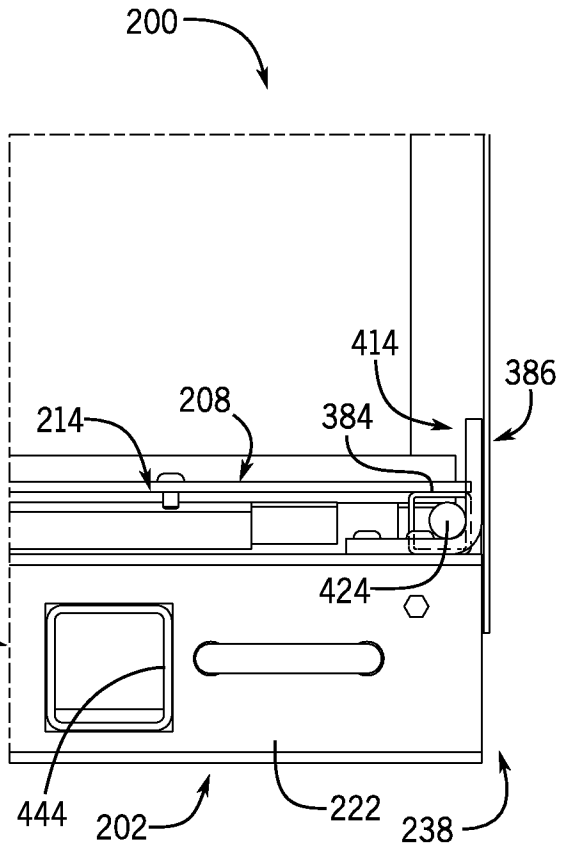
FIG. 46C is a schematic illustration of a side wall of the modular shipping container of FIG. 20 in a disassembled, or collapsed, state.
Figure 46B:
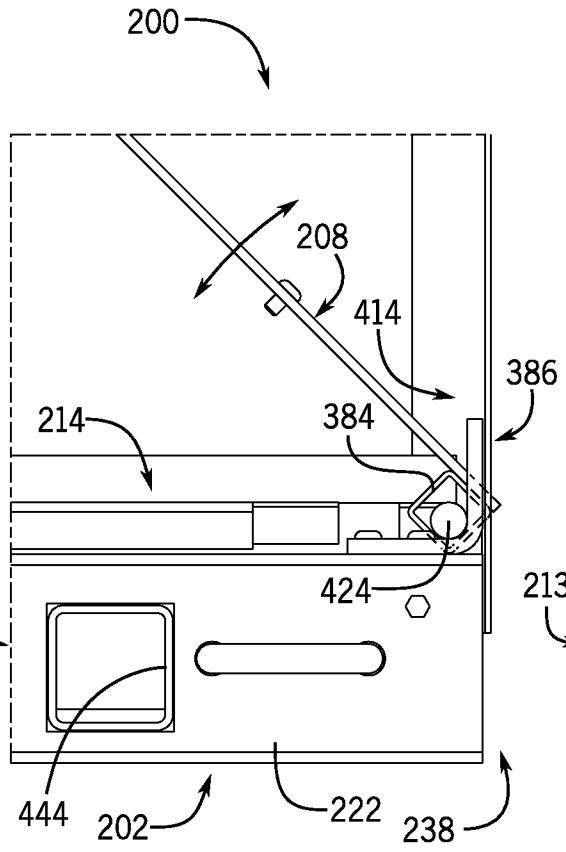
FIG. 46B is a schematic illustration of a side wall of the modular shipping container of FIG. 20 pivotally rotating.
Figure 46A:
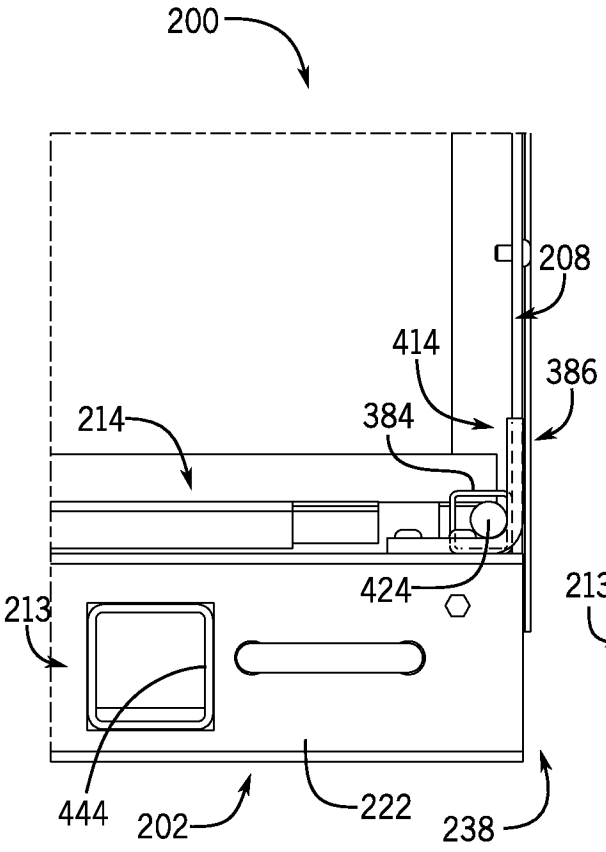
FIG. 46A is a schematic illustration of a side wall of the modular shipping container of FIG. 20 in an erected, or final, position.

Turning to FIGS. 41A and 41B, the second side wall 210 includes a second side tube hinge 398 and a shim tube 400 each attached to a bottom end 402 thereof. Each of the second side tube hinge 398 and the shim tube 400 extends longitudinally along the bottom end 402 of the second side wall 210, which may increase a rigidity of the second side wall 210. The second side tube hinge 398 defines a generally hollow tube with a generally rectangular profile. The shim tube 400 defines a generally hollow tube with a generally rectangular profile. The second side tube hinge 398 is coupled to and arranged above the shim tube 400. That is, the shim tube 400 is arranged between the second side tube hinge 398 and the base 202.

The second stationary hinge pin assembly 246 is configured to interact with the second side tube hinge 398 to enable a pivotal coupling between the second side wall 210 and the base 202. The second stationary hinge pin assembly 246 defines a general L-shape and includes an attachment portion 404 and a flange portion 406. The attachment portion 404 is attached to the distal end 240 of the first end rail 220 and is arranged generally parallel to the floor 214 of the base 202. The flange portion 406 extends upward substantially perpendicularly from the attachment portion 404. The flange portion 406 includes a coupling aperture 408 arranged therein. The coupling aperture 408 is configured to receive a fastening element 410 to removably couple the second stationary hinge pin assembly 246 to one of a plurality of retainer flanges 396.

A pivot pin 412 is attached to the second stationary hinge pin assembly 246 and extends therefrom. The pivot pin 412 is attached to the second stationary hinge pin assembly 246 on the flange portion 390. The pivot pin 412 extends from the second stationary hinge pin assembly 246 in a direction away from the first end wall 204 and is configured to be received within the second side tube hinge 398 of the second side wall 210. The arrangement of the pivot pin 412 within the second side tube hinge 398 enables the pivotal rotation of the second side wall 210 during assembly and disassembly of the modular shipping container 200, as will be described.

As described above, the second end rail 222 includes the plurality of first hinge apertures 248 arranged within the distal end 238 and the plurality of second hinge apertures 250 arranged within the distal end 242. Turing to FIGS. 42-45, the first stationary hinge pin assembly 244 is configured to cooperate with a first removable hinge pin assembly 414. The first removable hinge pin assembly 414 is configured to be removably attached to the second end rail 222 via a plurality of fastening elements (not shown) extending through a corresponding one of a plurality of mounting apertures 416 arranged within the first removable hinge pin assembly 414 and into the plurality of first hinge apertures 248. The first removable hinge pin assembly 414 is configured to interact with the first side tube hinge 384 to enable a pivotal coupling between the first side wall 208 and the base 202. The removable first hinge pin assembly 414 defines a general L-shape and includes an attachment portion 418 and a flange portion 420. The attachment portion 418 includes the plurality of mounting apertures 416 and is arranged generally parallel to the floor 214 of the base 202, when assembled. The flange portion 420 extends upward substantially perpendicularly from the attachment portion 418. The flange portion 420 includes a coupling aperture 422 arranged therein. The coupling aperture 422 is configured to receive a fastening element (not shown) to removably couple the removable first hinge pin assembly 414 to one of a plurality of retainer flanges 396 (best shown in FIG. 20), when assembled.

A pivot pin 424 is attached to the removable first hinge pin assembly 414 and extends therefrom. The pivot pin 424 is attached to the removable first hinge pin assembly 414 adjacent to a junction between the attachment portion 418 and the flange portion 420. The pivot pin 424 extends from the removable first hinge pin assembly 414 in a direction away from the second end wall 206, when assembled, and is configured to be received within the first side tube hinge 384 of the first side wall 208. The receipt of the pivot pin 397 of the first stationary hinge pin assembly 244 and the pivot pin 424 of the removable first hinge pin assembly 414 within the first side tube hinge 384 defines a first pivot axis $P_1$, and enables the pivotal rotation of the first side wall 208 during assembly and disassembly of the modular shipping container 200. It should be appreciated that the stationary nature (i.e., the permanent attachment) of the first stationary hinge pin assembly 244 is not meant to be limiting in any way and, in other non-limiting examples, for example, it may be removably coupled to the first end rail 220. The illustrated first stationary hinge pin assembly 244 and first removable hinge pin assembly 414 are provided with one stationary component and one removable component for ease of manufacture. For example, when manufacturing the modular shipping container 200, the first side tube hinge 384 of the first side wall 208 may first be slid over the pivot pin 397 of the first stationary hinge pin assembly 244. Then, the pivot pin 424 of the first removable hinge pin assembly 414 may be placed within the first side tube hinge 384 by the manufacturer and subsequently coupled to the second end rail 222 of the base 202.

The second stationary hinge pin assembly 246 is configured to cooperate with a second removable hinge pin assembly 426. The second removable hinge pin assembly 426 is configured to be removably attached to the second end rail 222 via a plurality of fastening elements (not shown) each extending through a corresponding one of a plurality of mounting apertures 428 arranged within the second removable hinge pin assembly 426 and into the plurality of second hinge apertures 250. The second removable hinge pin assembly 426 is configured to interact with the second side tube hinge 398 to enable a pivotal coupling between the second side wall 210 and the base 202. The second removable hinge pin assembly 426 defines a general L-shape and includes an attachment portion 430 and a flange portion 432. The attachment portion 430 includes the plurality of mounting apertures 428 and is arranged generally parallel to the floor 214 of the base 202, when assembled. The flange portion 432 extends upward substantially perpendicularly from the attachment portion 430. The flange portion 432 includes a coupling aperture 434 arranged therein. The coupling aperture 434 is configured to receive a fastening element (not shown) to removably couple the second removable hinge pin assembly 426 to one of a plurality of retainer flanges 396 (best shown in FIG. 20), when assembled.

A pivot pin 436 is attached to the second removable hinge pin assembly 426 and extends therefrom. The pivot pin 436 is attached to the second removable hinge pin assembly 426 on the flange portion 432. The pivot pin 436 extends from the second removable hinge pin assembly 426 in a direction away from the second end wall 206, when assembled, and is configured to be received within the second side tube hinge 398 of the second side wall 210. The receipt of the pivot pin 412 of the second stationary hinge pin assembly 246 and the pivot pin 436 of the second removable hinge pin assembly 426 within the second side tube hinge 398 defines a second pivot axis $P_2$, and enables the pivotal rotation of the second side wall 210 during assembly and disassembly of the modular shipping container 200. It should be appreciated that the stationary nature (i.e., the permanent attachment) of the second stationary hinge pin assembly 246 is not meant to be limiting in any way and, in other non-limiting examples, for example, it may be removably coupled to the first end rail 220. The illustrated second stationary hinge pin assembly 246 and second removable hinge pin assembly 426 are provided with one stationary component and one removable component for ease of manufacture. For example, when manufacturing the modular shipping container 200, the second side tube hinge 398 of the second side wall 210 may first be slid over the pivot pin 412 of the second stationary hinge pin assembly 246. Then, the pivot pin 436 of the second removable hinge pin assembly 426 may be placed within the second side tube hinge 398 by the manufacturer and subsequently coupled to the second end rail 222 of the base 202.

The pivot pins 412 and 436 of the second stationary hinge pin assembly 246 and the second removable hinge pin assembly 426 are arranged higher (i.e., on the respective flange portions 390 and 432), when compared to the pivot pins 397 and 424 of the first stationary hinge pin assembly 244 and the first removable hinge pin assembly 414. Thus, the pivot axis $P_2$ defined by the second side wall 210 is arranged higher, relative to the floor 214, when compared to the pivot axis $P_1$ defined by the first side wall 208.

When the modular shipping container 200, is in a disassembled state, the first side wall 208 is pivoted such that the first side wall 208 lays on the floor 214 (i.e., the first side wall 208 is in engagement with and arranged substantially parallel to the floor 214). In this position, the first side wall 208 defines a height from the floor 214. The raised height, relative to the floor 214, defined by the second pivot axis $P_2$ ensures that the second side wall 210, when pivoted toward the floor 214 to disassemble the modular shipping container 200, lays flat on the first side wall 208 (i.e., in engagement with the first side wall 208 and arranged substantially parallel to the floor 214). In this manner, a shipping height defined by the modular shipping container 200 (i.e., a height defined by the modular shipping container 200 in a disassembled state) is minimized.

Assembly and disassembly of the modular shipping container 200 will be described with reference to FIGS. 46A-47D. The modular shipping container 200 may be shipped to an end user in a disassembled, or collapsed, state, also known as kit form. In the disassembled state (FIG. 47A), the roof 212 is de-coupled from the first and second end walls 204 and 206, and the first and second side walls 208 and 210 by removal of the fastening elements 346 and 382. With the roof 212 de-coupled from the modular shipping container 200, the first side wall 208 is pivoted toward the floor 214 until the first side wall 208 engages the floor 214 and is arranged substantially parallel thereto. The pivotal coupling between the first stationary and removable hinge pin assemblies 244 and 414 and the first side tube hinge 384 enables first side wall 208 to easily pivot toward the floor 214 about the first pivot axis $P_1$. Subsequently, the second side wall 210 is pivoted toward the floor 214 until the second side wall 210 engages the first side wall 208 and is arranged substantially parallel thereto. The pivotal coupling between the second stationary and removable hinge pin assemblies 246 and 426 and the second side tube hinge 398 enables the second side wall 210 to easily pivot toward the floor 214 about the second pivot axis $P_2$.

Figure 47A:
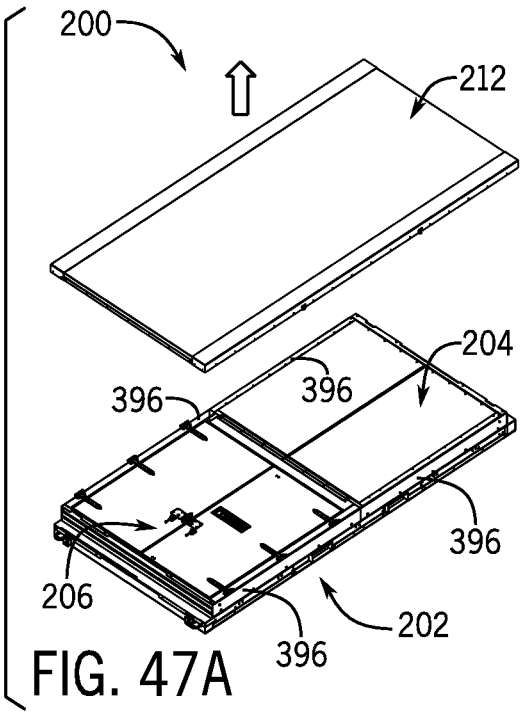
FIG. 47A is a partially exploded top, back, right isometric view of the modular shipping container of FIG. 20 in a disassembled state, or kit form.

Once the first and second side walls 208 and 210 are pivoted down to the floor 214, the first end wall 204 and the second end wall 206 are de-coupled from the base 202 and placed on top of the second side wall 210. The first and second end walls 204 and 206 are dimensioned to lay flat on the second side wall 210, as shown in FIG. 47A. Lastly, the roof 212 is placed on top of the first end wall 204 and the second end wall 206. Thus, the modular shipping container 200 is collapsible into a disassembled state. In the disassembled state, the modular shipping container 200 defines a drastically reduced volume, when compared to the assembled state, for ease of transport. Further, one or more additional modular shipping containers 200 may be stacked on top of one another to enable the compact shipment of multiple modular shipping containers 200 to an end user.

Figure 47B:
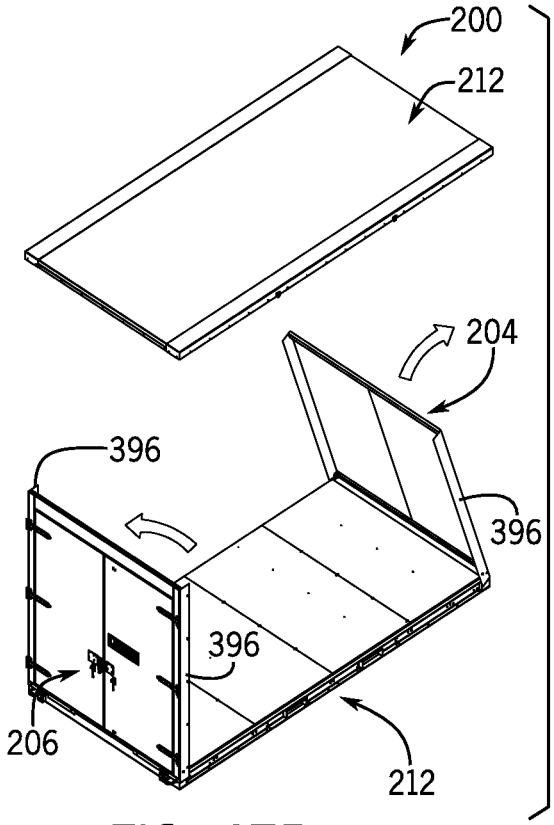
FIG. 47B is a partially exploded top, back, right isometric view of the modular shipping container of FIG. 20 in a partially assembled state with a pair of end walls partially erected.

When an end user receives a modular shipping container 200, in the disassembled state, the design of the modular shipping container 200 enables the end user to easily assemble the modular shipping container 200 on site. Initially, the roof 212 is removed from the disassembled modular shipping container 200 to enable erection of the first and second end walls 204 and 206 and the first and second side walls 208 and 210. Once the roof 212 is removed, the first and second end walls 204 and 206 are erected and coupled to the first and second end rails 220 and 222 of the base 202, respectively, as shown in FIG. 47B. With the first and second end walls 204 and 206 erected, the second side wall 210 is erected by pivotally rotating it about the second pivot axis $P_2$. As shown in FIGS. 47A-D, each of end of the first and second end walls 204 and 206 include one of the plurality of retainer flanges 396 attached thereto. A longitudinally opposed pair of the plurality of retainer flanges 396 adjacent to the second side rail 226 act as a stop for the second side wall 210 as it is erected. That is, the second stationary and removable hinge pin assemblies 246 and 426 and the second side tube hinge 398 enable the second side wall 210 to pivotally rotate until the second side wall 210 engages the respective pair of the retainer flanges 396. Thus, the second side wall 210 is pivotally rotated about the second pivot axis $P_2$ until the second side wall 210 is aligned in its final, erected position. Once in the final position, the second side wall 210 may be coupled, for example, via a plurality of bolts and nuts, to the pair of retainer flanges 396 and the base 202 to secure the second side wall 210 in its final position.

Figure 47C:
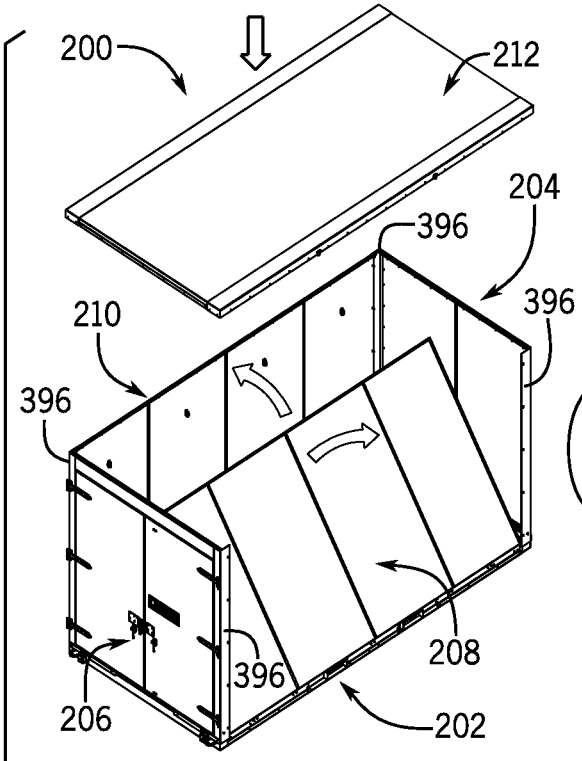
FIG. 47C is a partially exploded top, back, right isometric view of the modular shipping container of FIG. 1 in a partially assembled state with a pair of end walls and a side wall erected, and another side wall pivoted.
Figure 47D:
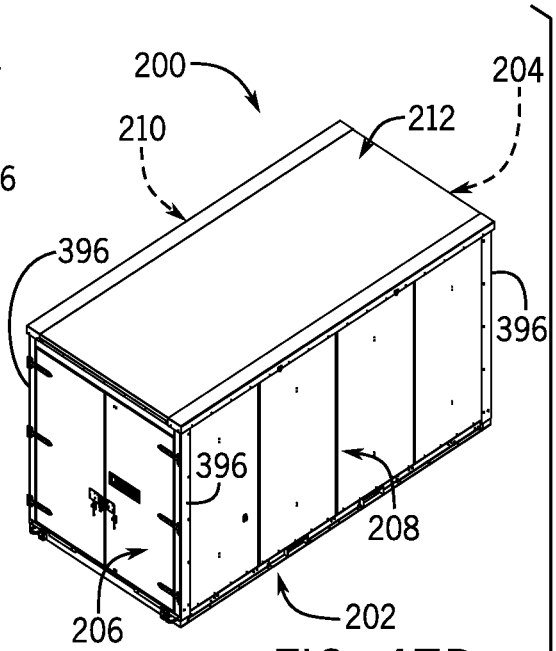
FIG. 47D is a top, back, right isometric view of the modular shipping container of FIG. 20 in an assembled state.

As shown in FIG. 47C, once the second side wall 210 is erected in its final position, the first side wall 208 is erected by pivotally rotating it about the first pivot axis $P_1$. As shown in The other longitudinally opposed pair of the plurality of retainer flanges 396 adjacent to the first side rail 224 act as a stop for the first side wall 208 as it is erected. That is, the first stationary and removable hinge pin assemblies 244 and 414 and the first side tube hinge 384 enable the first side wall 208 to pivotally rotate until the first side wall 208 engages the respective pair of the retainer flanges 396. Thus, the first side wall 208 is pivotally rotated about the first pivot axis $P_1$ until the first side wall 208 is aligned in its final, erected position. Once in the final position, the first side wall 208 may be coupled, for example, via a plurality of bolts and nuts, to the pair of retainer flanges 396 and the base 202 to secure the first side wall 208 in its final position, thereby completing the modular container assembly 200, as shown in FIG. 47D.

Figure 48:
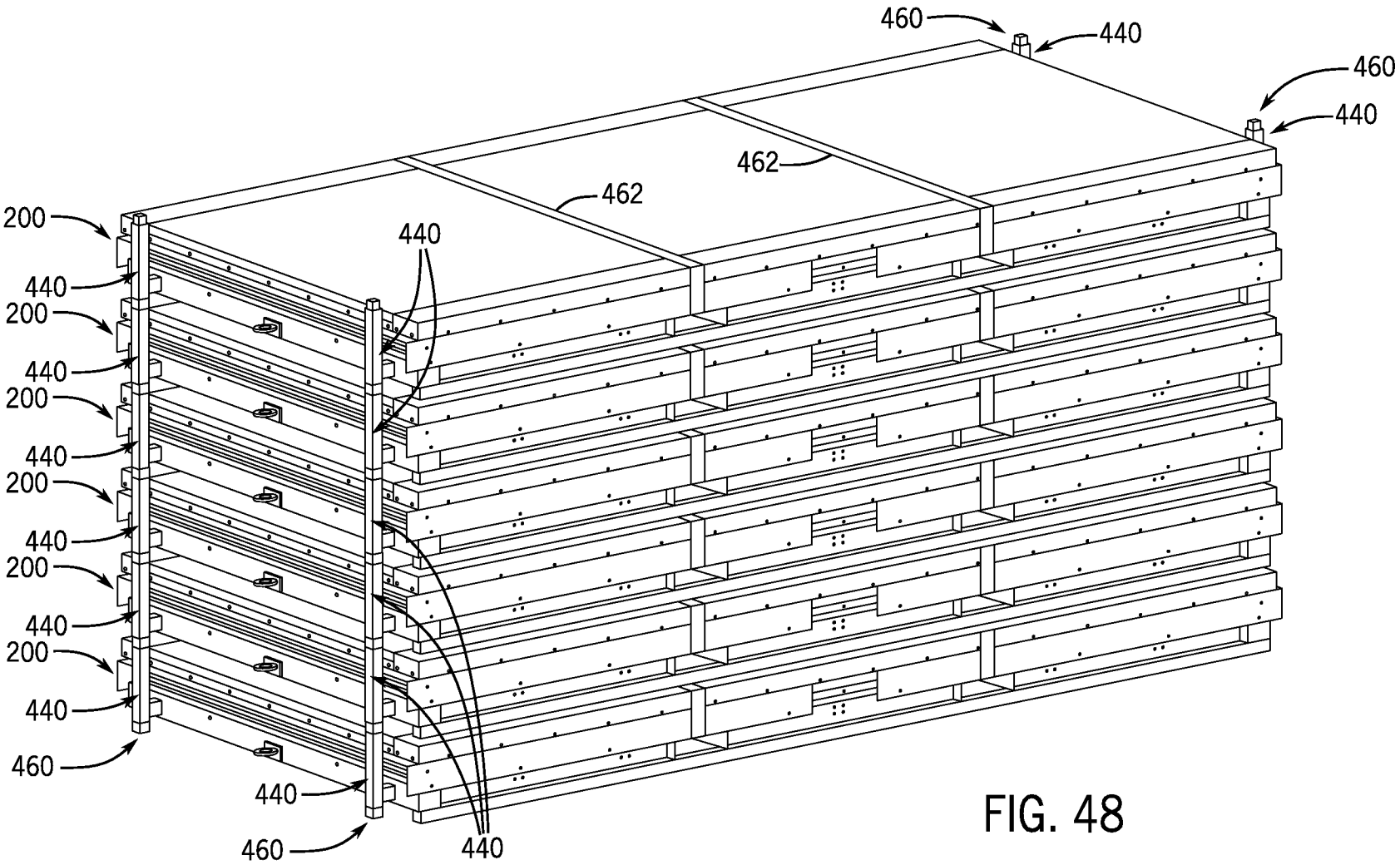
FIG. 48 is a top, front, left, isometric view of a plurality of the modular shipping containers of FIG. 20 in a disassembled state stacked on top of one another.

As described above, one or more modular shipping containers 200 may be stacked on top of one another to enable the compact shipment of multiple modular shipping containers 200 to an end user. FIG. 48 illustrates a plurality of the modular shipping container 200 stacked on top of one another for shipment to an end user. The illustrated plurality of the modular shipping containers 200 includes six of the modular shipping containers 200; however, this is not meant to be limiting in any way, and any number of the modular shipping containers 200 may be stacked upon one another. The plurality of the modular shipping containers 200 are held in a stacked state using a plurality of stacking brackets 440. The plurality of stacking brackets 440 are dimensioned to engage and support a pair of first stacking tubes 442 extending from the first end rail 220 and a pair of second stacking tubes 444 extending from the second end rail 222.

Figure 50:
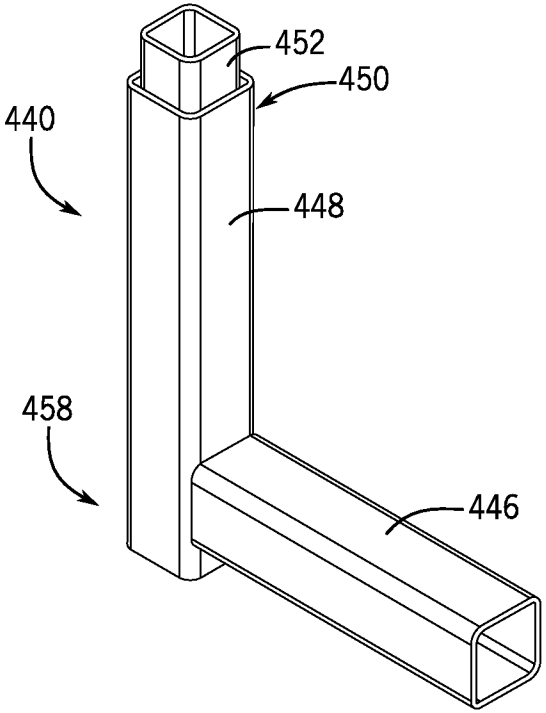
FIG. 50 is a top, front, right, isometric view of a stacking bracket used to stack the modular shipping containers of FIG. 48.
Figure 49:
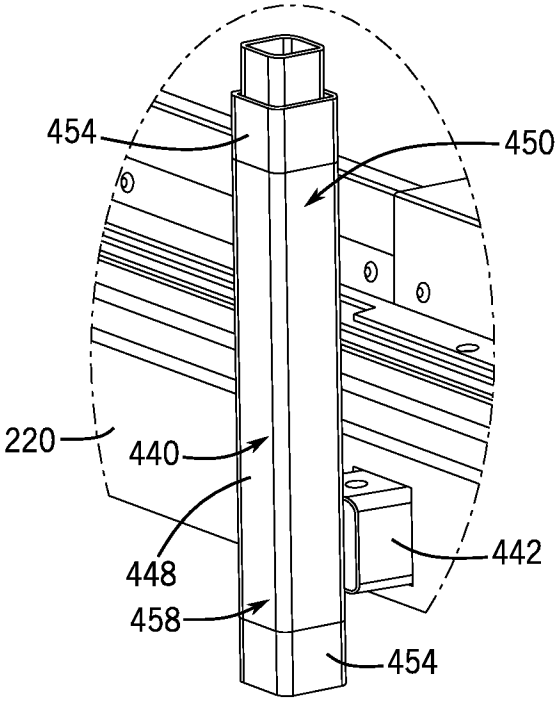
FIG. 49 is a magnified view of a portion of the stacked modular shipping containers of FIG. 48.

As shown in FIGS. 49 and 50, each of the plurality of stacking brackets 440 include a horizontal stacking tube 446 and a vertical stacking tube 448 coupled to the horizontal stacking tube 446. The horizontal stacking tubes 446 are dimensioned to be received within a corresponding one of the first stacking tubes 442 and the second stacking tubes 444 of the base 202. An end 450 of the vertical stacking tube 448, extending away from the horizontal stacking tube 446, includes a stacking post 452 extending therefrom. The stacking post 452 extends from inside the end 450 of the vertical stacking tube 448 and is dimensioned to receive a stacking adapter 454. The stacking adapters 454 are dimensioned to couple the end 450 of one stacking bracket 440 to an opposing end 458 of another stacking bracket 440. In this way, a plurality of stacking brackets 440 may be stacked on one another to form a stacking assembly 460. Each respective stacking bracket 440 in the stacking assembly 460 includes a horizontal stacking tube 446 received within a corresponding one of the pair of first stacking tubes 442 or one of the pair of second stacking tubes 444. Since the modular shipping container 200 includes the pair of first stacking tubes 442 arranged on the first end rail 220 and the pair of second stacking tubes 444 arranged on the second end rail 222, four of the stacking assemblies 460 may be utilized when stacking the plurality of the modular shipping containers 200.

Straps 462 may be used to secure the roof 212 to the rest of the modular shipping container 200 in the disassembled state. The straps 462 extend through a respective one of the fork tunnels 254 and around the roof 212 thereby securing the roof 212 to the rest of the modular shipping container 200, when disassembled.

The design and properties of the modular shipping container 200 reduce a shipping height defined by the modular shipping container 200 in a disassembled state, or a kit form. Additionally, the modular shipping container 200 enables an end user to assemble the modular shipping container 200 on site. It should be appreciated that the properties and functionality of the first stationary and removable hinge pin assemblies 244 and 414, the second stationary and removable hinge pin assemblies 246 and 426, the first side tube hinge 384, and the second side tube hinge 398 are not limited to the modular shipping container 200, and may be applied to other shipping containers.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

The invention claimed is:

1. A roof for a modular shipping container, the modular shipping container including a first end wall, a second end wall, a first side wall, and a second side wall, the roof comprising:

a roof sheet including a top surface and defining a first end, a second end, a first side, and a second side, wherein a wall extension extends longitudinally along and is coupled to an upper end of each of the first end, the second end, the first side, and the second side;

an outer angle support that extends around an inner periphery of the roof sheet and an inner angle support assembly that extends around the inner periphery within the outer angle support, wherein the inner angle support assembly includes an inner end angle support arranged under the roof sheet and extending along each of the first end and the second end and an inner side angle support arranged under the roof sheet and extending along each of the first side and the second side;

a plurality of brackets coupled to each of the inner end angle support and the inner side angle support, wherein each of the plurality of brackets is coupled to the inner end angle support and the inner side angle support by a fastening element;

a gasket extending longitudinally along and sealed between the wall extension and each of the inner end angle support and the inner side angle support; and a pair of skid plate assemblies, each of the pair of skid plate assemblies including a first skid end cap, a second skid end cap, and a skid plate and wherein one of the pair of skid plate assembles is arranged along the first side of the roof sheet, and the other of the pair of skid plate assemblies is arranged along the second side of the roof sheet, and wherein the first skid end caps, the second skid end caps, and the skid plates partially extend over the top surface of the roof sheet, and wherein the roof sheet is formed of a unitary piece of material, and wherein the roof sheet extends over and along at least a portion of the first end wall, a portion of the second end wall, a portion of the first side wall, and a portion of the second side wall, and wherein the roof sheet, the skid plates, and the outer angle support extend below a seal formed between the gasket and the wall extension.

2. The roof of claim 1, wherein the roof sheet is fabricated from a metal material.

3. The roof of claim 2, wherein the roof sheet is fabricated from aluminum.

4. The roof of claim 1, wherein each of the first skid end caps engages and partially covers the first end of the roof sheet.

5. The roof of claim 1, wherein each of the second skid end caps engages and partially covers the second end of the roof sheet.

6. The roof of claim 1, wherein each of the skid plates engages and covers a respective one of the first side and the second side of the roof sheet.

7. The roof of claim 1, wherein the skid plates are fabricated from a metal material.

8. The roof of claim 1, wherein the skid plates are fabricated from at least one of stainless steel, steel, aluminum, a composite material, a sandwiched composite material, a glass fiber reinforced polymer, a carbon fiber reinforced polymer, carbon fiber, or a steel strength plastic.

9. The roof of claim 1, further comprising a plurality of roof bows each extending between the first side and the second side under the roof sheet.

10. The roof of claim 9, wherein opposing ends of the plurality of roof bows are arranged between an outer side angle and an inner side angle.

11. The roof of claim 1, wherein the inner angle support assembly is configured to be removably coupled to each of the first end wall, the second end wall, the first side wall, and the second side wall.

12. The roof of claim 1, wherein the gasket is attached to the inner angle support assembly.

13. The roof of claim 1, wherein the wall extension defines a hook, or U-shaped, portion that extends past the upper end of each of the first end, the second end, the first side, and the second side.

14. The roof of claim 13, whereby fastening of the fastening elements brings the plurality of brackets into engagement with the hook, or U-shaped, portion of the wall extension and compresses the gasket between the wall extension and each of the inner side angle support and the inner end angle support.

15. A modular shipping container, comprising:

a base;

a first end wall;

a second end wall;

a first side wall;

a second side wall;

a wall extension extending longitudinally along and coupled to an upper end of each of the first end wall, the second end wall, the first side wall, and the second side wall; and a roof removably coupled to each of the first end wall, the second end wall, the first side wall, and the second side wall, the roof including:

a roof sheet including a top surface and defining a first end, a second end, a first side, and a second side;

an outer angle support that extends around an inner periphery of the roof sheet and an inner angle support assembly that extends around the inner periphery within the outer angle support, wherein the inner angle support assembly includes an inner end angle support arranged under the roof sheet and extending along each of the first end and the second end and an inner side angle support arranged under the roof sheet and extending along each of the first side and the second side;

a plurality of brackets coupled to each of the inner end angle support and the inner side angle support, wherein each of the plurality of brackets is coupled to the inner end angle support and the inner side angle support by a fastening element a gasket extending longitudinally along and sealed between the wall extension and each of the inner end angle support and the inner side angle support; and a pair of skid plate assemblies, wherein each of the pair of skid plate assemblies is defined by a first skid end cap, a second skid end cap, and an elongate skid plate and wherein one of the pair of skid plate assembles is arranged along the first side of the roof sheet, and the other of the pair of skid plate assemblies is arranged along the second side of the roof sheet, and wherein the skid plates partially extend over the top surface of the roof sheet, and wherein the roof sheet is formed of a unitary piece of material, and wherein the roof sheet extends over and along at least a portion of the first end wall, a portion of the second end wall, a portion of the first side wall, and a portion of the second side wall, and wherein the roof sheet, the skid plates, and the outer angle support extend below a seal formed between the gasket and the wall extension.

16. The modular shipping container of claim 15, wherein each of the first skid end caps engages and partially covers the first end of the roof sheet, and each of the second skid end caps engages and partially covers the second end of the roof sheet, and wherein each of the skid plates engages and covers a respective one of the first side and the second side of the roof sheet.

17. The modular shipping container of claim 15, wherein the wall extension defines a hook, or U-shaped, portion that extends past the upper end of each of the first end, the second end, the first side, and the second side.

18. The modular shipping container of claim 17, whereby fastening of the fastening elements brings the plurality of brackets into engagement with the hook, or U-shaped, portion of the wall extension and compresses the gasket between the wall extension and each of the inner side angle support and the inner end angle support.

* * * * *